US005657655A

United States Patent [19]

Yasuda et al.

[11] Patent Number: 5,657,655

[45] Date of Patent: Aug. 19, 1997

[54] TANDEM MILL SYSTEM AND WORK ROLL CROSSING MILL

[75] Inventors: Kenichi Yasuda, Katsuta; Kenjiro Narita, Hitachi; Yukio Hirama, Mito; Kouji Satou, Hitachi; Yasutsuga Yoshimura, Hitachi; Yoshio Takakura, Hitachi; Shinichi Kaga, Hitachi, all of Japan

[73] Assignee: Hitachi, Ltd., Tokyo, Japan

[21] Appl. No.: 711,999

[22] Filed: Sep. 10, 1996

Related U.S. Application Data

[63] Continuation of Ser. No. 357,068, Dec. 14, 1994, abandoned, which is a continuation of Ser. No. 16,956, Feb. 12, 1993, abandoned.

[30] Foreign Application Priority Data

Feb. 14, 1992 [JP] Japan ..... 4-027969

[51] Int. Cl.[6] ..... B21B 1/22; B21B 27/06

[52] U.S. Cl. ..... 72/11.5; 72/234; 72/236; 72/241.4

[58] Field of Search ..... 72/201, 234, 241.2, 72/241.4, 247, 8.8, 11.5, 14.1, 236

[56] References Cited

U.S. PATENT DOCUMENTS

| | | | |
|---|---|---|---|
| 3,208,253 | 9/1965 | Roberts | 72/21 |
| 3,605,473 | 9/1971 | Lyon et al. | 72/201 |
| 4,385,512 | 5/1983 | Matsumoto et al. | 72/366.2 |

FOREIGN PATENT DOCUMENTS

| | | |
|---|---|---|
| 276743 | 8/1988 | European Pat. Off. . |
| 506138 | 9/1992 | European Pat. Off. . |
| 53-2140 | 1/1978 | Japan . |
| 55-2121 | 1/1980 | Japan . |
| 55-144311 | 11/1980 | Japan . |
| 57-118804 | 7/1982 | Japan . |
| 9118804 | 7/1982 | Japan . |
| 57-206510 | 12/1982 | Japan . |

(List continued on next page.)

OTHER PUBLICATIONS

Ginzburg, *Steel –Rolling Technology*, 1989, sec. 37.6, pp. 716–717.

Kapnin, Vladimir Victorovich, "Development of Main Technological Parameters of Strip Rolling Process in Crossed Rolls of Four–High Stand", Ministry of Higher and Secondary Education, Moskowsky Ordena Oktaybrskoy Revolutsii i Ordena Trudovogo Krasnogo Znameni Institut Staly i Splavov, pp. 16–21 and translation, 1987.

(List continued on next page.)

*Primary Examiner*—Lowell A. Larson
*Assistant Examiner*—T. Schoeffler
*Attorney, Agent, or Firm*—Evenson McKeown Edwards & Lenahan, PLLC

[57] ABSTRACT

In a tandem mill system, at least one first type rolling mill is arranged in the upstream side and at least one second type rolling mill is arranged in the downstream side. The first type rolling mill is of the so-called work roll crossing mill in which a pair of work rolls are inclined with respect to a pair of back-up rolls supporting the work rolls and simultaneously crossed each other in a horizontal plane to control transverse thickness distribution of a strip. The second type rolling mill is of the so-called HC mill which controls the strip crown and shape by a combination of axial movement of intermediate rolls and work roll bending. Such an arrangement makes it possible to increase a capability of controlling the strip crown and shape, particularly, a capability of correcting the quarter buckle, and eliminate a fear of causing scratches on the strip and roll surfaces, with the result of improved production efficiency. Plural lines of lubricant supply device are also provided to stop supply of a lubricant immediately before biting of the strip into the work roll crossing mill and start the supply again after the biting. A system of lubricating the work roll crossing mill is thereby improved.

26 Claims, 20 Drawing Sheets

FOREIGN PATENT DOCUMENTS

| | | | |
|---|---|---|---|
| 0038603 | 3/1983 | Japan | 72/201 |
| 58-61902 | 4/1983 | Japan . | |
| 58-23161 | 5/1983 | Japan . | |
| 58-148009 | 9/1983 | Japan . | |
| 0157504 | 9/1983 | Japan | 72/241.2 |
| 0039409 | 3/1984 | Japan | 72/201 |
| 9144503 | 8/1984 | Japan . | |
| 59-41804 | 10/1984 | Japan . | |
| 0192403 | 8/1989 | Japan | 72/201 |
| 0004916 | 1/1992 | Japan | 72/201 |
| 0037402 | 2/1992 | Japan | 72/241.4 |

OTHER PUBLICATIONS

V.N. Khloponin, V.V. Kapnin, "Investigation Into The Methods For Adjustment of A Strip Lateral Section in A Four–High Mill Stand", *Proceedings of Higher Educational Institutions, Ferrous Metallurgy,* No. 7, 1986, pp. 82–85 and translation.

V.V. Kapnin, V.N. Khloponin, "On Determining Contact Pressure inRolling with Crossed Working Rolls", p. 149 and translation, 1986.

European Search Report, *The Hague,* completed May 6, 1993.

Abstracts of Japan, JP 4,004,916, *Method For Supplying Coolant For Lubricating and Cooling in Cold Rolling,* (Oct. 04 1992.

Y. Miyai, Iron and Steel Engineer, *Modernization and Operation of NKK's Keihin Hot Strip Mill,* vol. 68, No. 11, (1991).

T. Kimura, et al., Hitachi Review, *Hot Strip Mill Capability Enhanced by UC–Mill Technology,* vol. 39, No. 4, (1990).

Specification of Pending U.S. Application Serial No. 07/859,945.

A:DETRIMENTAL CONTACT PORTIONS WHERE BENDING DEFORMATION OF WORK ROLLS DUE TO ROLL BENDEING FORCES IS IMPEDED

TANDEM MILL SYSTEM AND WORK ROLL CROSSING MILL

This application is a continuation of application Ser. No. 08/357,068, filed on Dec. 14, 1994, now abandoned, which is a continuation of application Ser. No. 08/016,956 filed Feb. 12, 1993, now abandoned.

BACKGROUND OF THE INVENTION

The present invention relates to a work roll crossing mill in which a pair of work rolls are inclined in respective horizontal planes with respect to associated back-up rolls and also crossed each other, and more particularly to a hot or cold tandem mill system including such work roll crossing mills.

In a conventional tandem mill system, rolling mills arranged along a rolling line have usually been all constituted by 4-high mills. Therefore, the strip crown (transverse thickness distribution) and the shape (flatness) of a strip to be rolled have been controlled by roll bending apparatus of the 4-high mills. However, because the use of only roll bending has limitations in a capability of controlling the strip crown and shape, there have recently been developed tandem mill systems equipped with various high-performance rolling mills. JP, B, 53-2140 and JP, B, 55-2121, for example, disclose a tandem mill system equipped with a rolling mill (see FIG. 3, hereinafter referred to as an HC mill) which has rolls movable in the axial direction and controls the strip crown and shape by a combination of movement of those rolls and bending of work rolls. This tandem mill system enabled control of the quarter buckle that could not be corrected until then. Also, JP, B, 59-41804 discloses a tandem mill system comprised of only those rolling mills in which rolls are crossed each other in respective horizontal planes to control the strip crown and so forth.

As a mill which comprises a 4-high mill capable of using large-diameter work rolls and has a high capability of strip crown control, JP, B, 58-23161 discloses a rolling mill (see FIG. 16, hereinafter referred to as a PC mill) in which pairs of work rolls and back-up rolls, one pair being on each of the upper and lower sides, are crossed together each other in respective horizontal planes.

SUMMARY OF THE INVENTION

Controlling the quarter buckle requires two or more shape correcting means which can provide different influences upon a pattern of transverse thickness distribution. As described in the above-cited JP, B, 53-2140, for example, the quarter buckle can be corrected by properly combining a means which gives an influence upon the transverse thickness distribution pattern ranged from the vicinity of the strip center and a means which concentrically applies an effect to the strip ends.

A capability of quarter buckle control is maximized by constituting all stands by 6-high HC mills in which work rolls can be made small in diameter, as described in the above-cited JP, B, 53-2140 and JP, B, 55-2121. The use of 6-high HC mills is also advantageous in that rolling load required is small. However, such a tandem mill system has drawbacks below. In the case of hot rolling, since rolls are brought into contact with strips at high temperatures in several upstream stands, small-diameter rolls are heated up to high temperatures soon because of their small heat capacity and the quality of roll material is deteriorated. Also, if work rolls of upstream stands have a small diameter, those work rolls cannot bite a thick strip therebetween. This drawback equally applies to the case of cold rolling. For that reason, regardless of whether the system is used for hot rolling or cold rolling, large-diameter work rolls are required in upstream stands of the tandem mill system. A 6-high HC mill having large-diameter work rolls, however, becomes an extremely large-sized apparatus and increases the construction cost. Still another drawback is in that because of being less susceptible to bending, large-diameter work rolls have a small roll bending effect and hence exhibit a small capability of controlling the strip crown and so forth.

As mentioned before, while the above-cited JP, B, 58-23161 discloses the PC mill as a mill which comprises a 4-high mill capable of using large-diameter work rolls and has a great capability of strip crown control, a tandem mill system in which all stands are constituted by PC mills has drawbacks below.

First, there is no capability of quarter buckle control. More specifically, in order to control the quarter buckle, a means for giving an influence upon the transverse thickness distribution pattern ranged from the vicinity of the strip center and a means for concentrically applying an effect to the strip ends are properly combined with each other. However, roll crossing effects resulted from any crossing type mills including a PC mill influence the transverse thickness distribution pattern ranged from the vicinity of the strip center. Because of the large roll diameter, bending of work rolls cannot concentrically apply an effect to the strip ends and provides a similar pattern change to that of the roll crossing effect. In a roll crossing type mill, therefore, the quarter buckle cannot be corrected even by the combined use of roll crossing and roll bending. Further, during the rolling in which a strip is passing a mill, a screwdown force is directly acting on a back-up roll chock from a screwdown device. Accordingly, in a PC mill in which back-up rolls are crossed each other along with work rolls, it is difficult to control a cross angle during the rolling of a strip. In this point, too, the above tandem mill system has limitations in correcting the quarter buckle.

Secondly, no considerations are paid to scratches of rolls due to strips. More specifically, in both hot and cold rolling, a strip-caused scratch occurs on the roll surface during the rolling. The occurrence of a strip-caused scratch on the roll surface deteriorates the surface quality of rolled products and hence requires replacement of rolls. In particular, if a strip-caused scratch occurs in any upstream roll, the scratch is transferred to downstream rolls as well and the number of rolls to be replaced is increased, thus leading to a large influence.

In the case of hot rolling, rolls are brought into contact with strips at high temperatures in several upstream stands and the roll surface inevitably changes in quality such that the so-called scale is created thereon. Taking the fact into account, it has been practiced to intentionally or positively deposit the scale as one kind of surface coating. The scale is very hard and no particular problems arise if it is uniformly deposited over the roll surface. However, deposition of the scale onto the roll surface is not so stable in its-creation process immediately after roll replacement that the scale once deposited is often peeled off and caught up between the roll and the strip, thereby causing a scratch. Accordingly, roll replacement is required and time loss necessary for the roll replacement leads to a reduction in production efficiency. Moreover, the necessity of rolling those strips, which especially tend to create the scale, immediately after roll replacement has imposed limitations on the degree of freedom in schedule.

A first object of the present invention is to provide a tandem mill system which has a high capability of controlling the strip crown and shape, particularly, a high capability of correcting the quarter buckle, has a high rate of production, and is free from a fear of causing scratches on the strip and roll surfaces, by arranging work roll crossing mills in each of which a pair of work rolls are inclined with respect to associated back-up rolls and also crossed each other.

A second object of the present invention is to improve, in a system comprising a plurality of work roll crossing mills in each of which a pair of work rolls are inclined with respect to associated back-up rolls and also crossed each other, a manner of lubricating between the work rolls and the back-up rolls supporting the work rolls, thereby providing a tandem mill system which enables smooth lubrication.

A third object of the present invention is to improve, in a work roll crossing mill in which a pair of work rolls are inclined with respect to associated back-up rolls and also crossed each other, as well as a tandem mill system including a plurality of such work roll crossing mills, a manner of lubricating between the work rolls and the back-up rolls supporting the work rolls, thereby providing a tandem mill system and a work roll crossing mill which enable smooth lubrication.

To achieve the above first object, in accordance with the present invention, there is provided a tandem mill system in which a plurality of rolling mills are arranged along a rolling line, said plurality of rolling mills including (a) at least one first type rolling mill comprising a pair of work rolls and a pair of back-up rolls, said pair of work rolls being inclined with respect to a pair of said back-up rolls supporting said work rolls and simultaneously crossed each other in respective horizontal planes to control transverse thickness distribution of a strip; and (b) at least one second type rolling mill having a shape control function of providing an influence upon a pattern of the transverse thickness distribution of said strip different from the influence provided by said first type rolling mill.

To achieve the above first object, in accordance with the present invention, there is also provided a tandem mill system in which a plurality of rolling mills are arranged along a rolling line, said plurality of rolling mills including (a) at least one first type rolling mill comprising a pair of work rolls and a pair of back-up rolls, said pair of work rolls being inclined with respect to said pair of back-up rolls supporting said work rolls and simultaneously crossed each other respective horizontal planes to control transverse thickness distribution of a strip; and (b) at least one second type rolling mill comprising a pair of work rolls and a pair of rolls movable in an axial direction, said pair of work rolls being applied with bending forces to control the transverse thickness distribution of said strip by a combination of the roll movement and the work roll bending.

To achieve the above first object, in accordance with the present invention, there is further provided a tandem mill system in which a plurality of rolling mills are arranged along a rolling line, said plurality of rolling mills including (a) at least one first type rolling mill comprising a pair of work rolls and a pair of back-up rolls, said pair of work rolls being inclined with respect to said pair of back-up rolls supporting said work rolls and simultaneously crossed each other in respective horizontal planes to control transverse thickness distribution of a strip; and (b) at least one second type rolling mill comprising a pair of bottle shaped rolls mutually symmetrical about a point and movable in an axial direction, said pair of bottle shaped rolls being moved in opposite directions to each other to control the transverse thickness distribution of said strip.

To achieve the above first object, in accordance with the present invention, there is still further provided a tandem mill system in which a plurality of rolling mills are arranged along a rolling line, said plurality of rolling mills including (a) at least one first type rolling mill comprising a pair of work rolls and a pair of back-up rolls, said pair of work rolls being inclined with respect to said pair of back-up rolls supporting said work rolls and simultaneously crossed each other in respective horizontal planes, said pair of work rolls being also applied with bending forces to control transverse thickness distribution of a strip by a combination of the roll crossing and the work roll bending; and (b) at least one second type rolling mill comprising a pair of work rolls and a pair of back-up rolls, said pair of work rolls being crossed each other together with said pair of back-up rolls supporting said work rolls in respective horizontal planes, said pair of work rolls being also applied with bending forces to control the transverse thickness distribution of said strip by a combination of the roll crossing and the work roll bending.

In any of the above tandem mill systems, preferably, said first type rolling mill is arranged in at least a head stand of said plurality of rolling mills. Also preferably, said second type rolling mill is arranged in at least a tail stand of said plurality of rolling mills. Further preferably, said first type rolling mill is arranged in a stand upstream of said second type rolling mill.

In any of the above tandem mill systems, preferably, said first type rolling mill includes means for controlling a cross angle of said pair of work rolls during the rolling in which said strip is passing said first type rolling mill.

In any of the above tandem mill systems, preferably, said first type rolling mill includes lubricant supply means for lubricating between said work rolls and said back-up rolls supporting said work rolls.

To achieve the above second object, in accordance with the present invention, there is provided, on the basis of any of the above tandem mill systems, a tandem mill system further including (c) lubricant supply means provided for said first type rolling mill for lubricating between said work rolls and said back-up rolls supporting said work rolls; (d) first detection means provided upstream of said first type rolling mill for detecting the presence or absence of said strip; (e) second detection means provided for said first type rolling mill for detecting biting of said strip; and (f) control means for controlling said lubricant supply means in response to signals from said first and second detection means.

To achieve the above second and third objects, in accordance with the present invention, there is provided, on the basis of any of the above tandem mill systems, a tandem mill system further including (c) plural lines of lubricant supply means provided for said first type rolling mill for lubricating between said work rolls and said backup rolls supporting said work rolls, said plural lines of lubricant supply means having respective lubricant supply sources per line.

In the above tandem mill system, preferably, said first type rolling mill is provided plural in number, said plural first type rolling mills are divided into plural groups in the direction of movement of said strip, and said plural lines of lubricant supply means are divided into plural lines corresponding to the plural groups of said first type rolling mills. In this case, preferably, out of said plural lines of lubricant supply means, the line corresponding to the upstream group of said first type rolling mills has said lubricant supply source containing a lubricant with higher density, and the line corresponding to the downstream group of said first type rolling mills has said lubricant supply source containing a lubricant with lower density.

Also preferably, said plural lines of lubricant supply means are divided into two lines corresponding to the upper rolls and the lower rolls of said first type rolling mill. In this case, preferably, out of said two lines of lubricant supply means, the line corresponding to said upper rolls has said lubricant supply source containing a lubricant with higher density, and the line corresponding to said lower rolls has said lubricant supply source containing a lubricant with lower density.

Further preferably, said plural lines of lubricant supply means have a number of nozzles arranged along a roll axial direction in said first type rolling mill, said number of nozzles are divided into plural groups the roll axial direction, and said plural lines of lubricant supply means are divided into plural lines corresponding to the plural groups of said nozzles. In this case, out of said plural lines of lubricant supply means, the line corresponding to the nozzle group in a roll central portion has said lubricant supply source containing a lubricant with higher density, and the line corresponding to the nozzle group in a roll end portion has said lubricant supply source containing a lubricant with lower density.

Further preferably, said plural lines of lubricant supply means each have a number of nozzles arranged along a roll axial direction in said first type rolling mill, and said lubricant supply sources for said plural lines of lubricant supply means contain lubricants with different densities.

To achieve the above second object, in accordance with the present invention, there is provided a tandem mill system in which a plurality of rolling mills are arranged along a rolling line, comprising (a) said plurality of rolling mills including a plurality of work roll crossing mills each of which comprises a pair of work rolls and a pair of back-up rolls, said pair of work rolls being inclined with respect to a pair of said back-up rolls supporting said work rolls and simultaneously crossed each other in respective horizontal planes to control transverse thickness distribution of a strip; (b) lubricant supply means provided for each of said plurality of work roll crossing mills for lubricating between said work rolls and said back-up rolls supporting said work rolls; (c) first detection means provided upstream of said plurality of work roll crossing mills for detecting the presence or absence of said strip; (d) second detection means provided for each of said plurality of work roll crossing mills for detecting biting of said strip; and (e) control means for controlling said lubricant supply means in response to signals from said first and second detection means.

To achieve the above second and third objects, in accordance with the present invention, there is provided a tandem mill system in which a plurality of rolling mills are arranged along a rolling line, comprising (a) said plurality of rolling mills including a plurality of work roll crossing mills each of which comprises a pair of work rolls and a pair of back-up rolls, said pair of work rolls being inclined with respect to said pair of back-up rolls supporting said work rolls and simultaneously crossed each other in respective horizontal planes to control transverse thickness distribution of a strip; and (b) plural lines of lubricant supply means provided for each of said plurality of work roll crossing mills for lubricating between said work rolls and said back-up rolls supporting said work rolls, said plural lines of lubricant supply means having respective lubricant supply sources per line.

To achieve the above third object, in accordance with the present invention, there is provided a work roll crossing mill comprising a pair of work rolls and a pair of back-up rolls, said pair of work rolls being inclined with respect to said pair of back-up rolls supporting said work rolls and simultaneously crossed each other in respective horizontal planes to control transverse thickness distribution of a strip, wherein said mill includes plural lines of lubricant supply means for lubricating between said work rolls and said back-up rolls supporting said work rolls, said plural lines of lubricant supply means having respective lubricant supply sources per line.

In the present invention concerned with the first object, the first type rolling mill is constituted by the so-called work roll crossing mill to control the transverse thickness distribution, i.e., the strip crown, ranged from the vicinity of the strip center based on its roll crossing effect, and the second type rolling mill has a shape control function to correct the transverse thickness distribution ranged from the vicinity of the strip ends, thereby exhibiting a high capability of quarter buckle control. Also, in the work roll crossing mill, since a cross angle of the work rolls can be controlled even during the rolling of the strip, during passing cross angle control is permitted.

In the work roll crossing mills used as the first type rolling mill, since the work rolls are rotated in such a condition that they are inclined with respect to the back-up rolls supporting the work rolls, there occur slight slips between the work rolls and the back-up rolls, causing these rolls to grind each other. As a result, scratches due to the scale are not caused in hot rolling, and a fear of causing scratches on the roll surfaces is eliminated. Thus, the roll surfaces are always kept clean in either case.

Furthermore, since the first type rolling mill controls the transverse thickness distribution of the strip based on the roll crossing, large-diameter work rolls can used therein. Accordingly, when the present invention is applied to hot rolling, the work rolls are prevented from being heated up to high temperatures and deterioration of the roll material can be suppressed. In addition, the use of large-diameter work rolls can ensure positive biting of thick strips.

The rolling mill which controls the transverse thickness distribution of the strip by a combination of the roll movement and the work roll bending, and the rolling mill which controls the transverse thickness distribution of the strip by moving the bottle shaped rolls, mutually symmetrical about a point, in opposite directions to each other have shape control functions of giving influences, different from the influence given by the first type rolling mill, upon a pattern of the transverse thickness distribution of the strip, thus making it possible to correct the transverse thickness distribution ranged from the vicinity of the strip ends. Therefore, a capability of quarter buckle control can be developed by using any of the above rolling mills as the aforesaid second type rolling mill.

Between the case where the transverse thickness distribution of the strip is controlled by the work roll crossing mill based on a combination of the roll crossing and the work roll bending, and the case where the transverse thickness distribution of the strip is controlled by the so-called PC mill, in which the work rolls and the back-up rolls are crossed together each other, based on a combination of the roll crossing and the work roll bending, there occurs a difference in characteristics of the work roll bending, when the work roll diameter is small, due to different degrees of interference in detrimental contact portions between the work rolls and the back-up rolls. In other words, the work roll bending imposes a greater influence upon the transverse thickness distribution ranged from the vicinity of the strip center in the work roll crossing mill than in the PC mill. Accordingly, a capability of quarter buckle control can also be developed by combining the work roll crossing mill and the PC mill which have their own work roll bending functions.

With the first type rolling mill arranged in the upstream side and the second type rolling mill arranged in the downstream side, respectively, the strip crown is controlled in the upstream side and the shape near the strip ends is corrected in the downstream side, thereby developing a high capability of quarter buckle control.

With the lubricant supply means provided for the first type rolling mill for lubricating between the work rolls and the back-up rolls, thrust forces produced in the axial direction between the work rolls and the back-up rolls because of only the work rolls being crossed are reduced and troubles due to excessive thrust forces are prevented.

In the present invention concerned with the second object, the lubricant supply means is provided for the first type rolling mill (the work roll crossing mill) for lubricating between the work rolls and the back-up rolls, and there are further provided the first detection means for detecting the presence or absence of the strip, the second detection means for detecting biting of the strip, and the control means for controlling said lubricant supply means in response to signals from the first and second detection means. It is therefore possible to stop supply of a lubricant immediately before biting of the strip into the first type rolling mill (the work roll crossing mill) and start the supply again after the biting. As a result, slip troubles at the time of biting into the first type rolling mill are eliminated and production efficiency is improved.

In the present invention concerned with the second and third objects, the plural lines of lubricant supply means are provided for the first type rolling mill (the work roll crossing mill) and the lubricant supply sources are separately provided per line. Accordingly, by changing density or a friction force reducing capability of the lubricant depending on spots where the lubricant is to be supplied, the amount of lubricant used can be reduced while providing required lubrication.

There is such a tendency in the tandem mill system that rolling load is large in the upstream stands and, to the contrary, it is small in the downstream stands. Also, thrust forces produced in the work roll crossing mill are almost proportional to rolling load. Therefore, the upstream stands undergo larger thrust forces than the downstream stands. In view of the above, where the first type rolling mill is provided plural in number, a plurality of the first type rolling mills are divided into plural groups and, correspondingly to these groups of the first type rolling mills, the plural lines of lubricant supply means are also divided into plural groups. This enables the lubricant supply source, which is associated with the line corresponding to the upstream group of the first type rolling mills, to contain a lubricant with higher density and the lubricant supply source, which is associated with the line corresponding to the downstream group of the first type rolling mills, to contain a lubricant with lower density. As a result, the amount of lubricant used can be reduced while providing required lubrication to the work roll crossing mill. Additionally, the thrust forces are made uniform in all the stands, the time wastefully consumed is cut down, and hence production efficiency is improved.

In many usual cases, roll lubricating conditions in the work roll crossing mill are different between the upper and lower sides, and roll wears are also different between the upper and lower sides. Generally, since a large amount of cooling water is used in hot rolling, the lubricant is more easily washed away in the lower rolls. Therefore, the coefficient of friction in the lower side is increased and wears of the lower rolls become larger correspondingly. In view of the above, the plural lines of lubricant supply means are divided into two lines between the upper rolls and the lower rolls of the first type rolling mill. This enables the lubricant supply source, which is associated with the line corresponding to the upper rolls, to contain a lubricant with higher density and the lubricant supply source, which is associated with the line corresponding to the lower rolls, to contain a lubricant with lower density. As a result, the amount of lubricant used can be reduced while providing required lubrication to the work roll crossing mill.

Moreover, contact pressure between the back-up roll and the work roll is usually distributed such that higher pressure is applied to a roll central portion where the strip is nipped, than applied to roll end portions. Accordingly, the friction force is also distributed in the axial direction of the roll such that the greater force is applied to the roll central portion. In view of the above, a number of the nozzles arranged along the roll axial direction in the first type rolling mill are divided into plural groups in the roll axial direction and, correspondingly to these groups of the nozzles, the plural lines of lubricant supply means are also divided into plural groups. This enables the lubricant supply source, which is associated with the line corresponding to the nozzle group for the roll central portion, to contain a lubricant with higher density and the lubricant supply source, which is associated with the line corresponding to the nozzle groups for the roll end portions, to contain a lubricant with lower density. As a result, the amount of lubricant used can be reduced while providing required lubrication to the work roll crossing mill.

With such an arrangement that the plural lines of lubricant supply means each have a number of nozzles arranged along the roll axial direction in the first type rolling mill, and the lubricant supply sources for the plural lines of lubricant supply means contain lubricants with different densities, when the detected thrust forces becomes too large, the lubricant with higher different density can be supplied so as to prevent a trouble of roll seizure or the like due to excessive thrust forces and hence prolong the service life of the rolls.

DETAILED DESCRIPTION OF THE PREFERRED EMBODIMENTS

FIRST EMBODIMENT

To begin with, a first embodiment of the present invention will be described with reference to FIGS. 1 to 5. In this embodiment, the present invention is applied to hot rolling.

Figure 1:
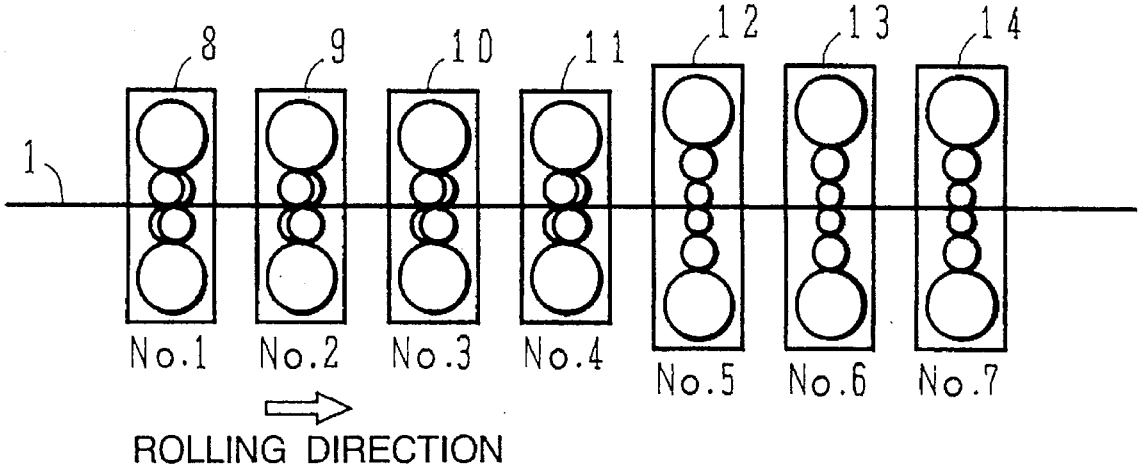
FIG. 1 is a schematic view of a tandem mill system according to a first embodiment of the present invention.
Figure 2:
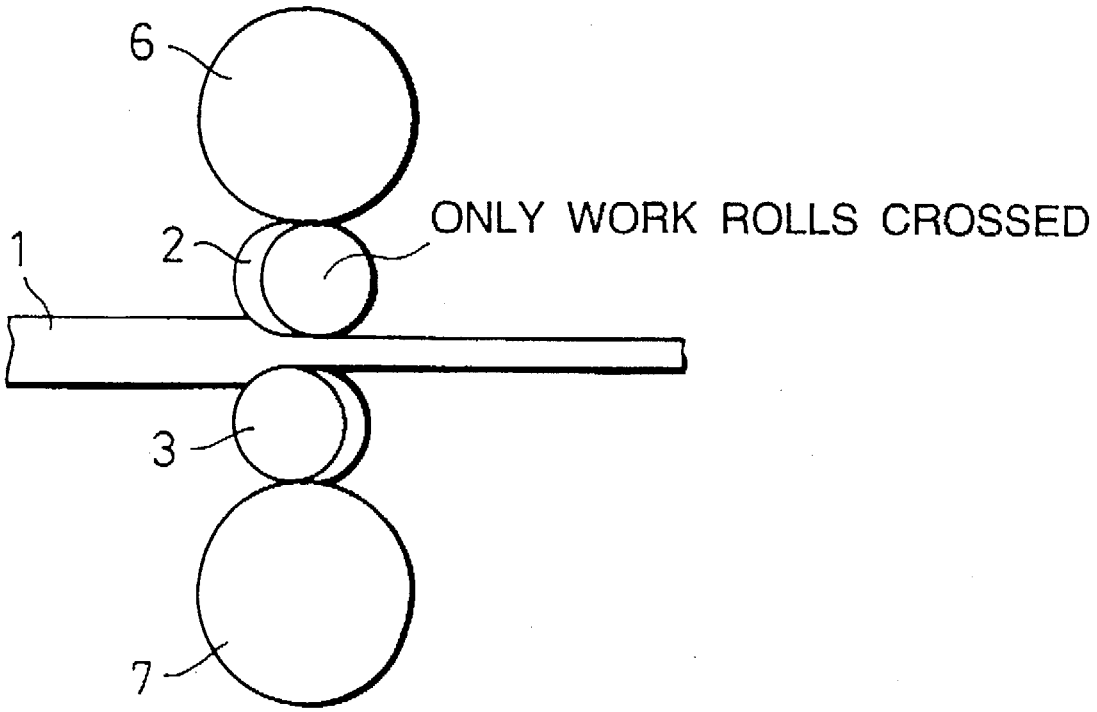
FIG. 2 is a schematic view of a first type rolling mill (a work roll crossing mill) shown in FIG. 1.
Figure 3:
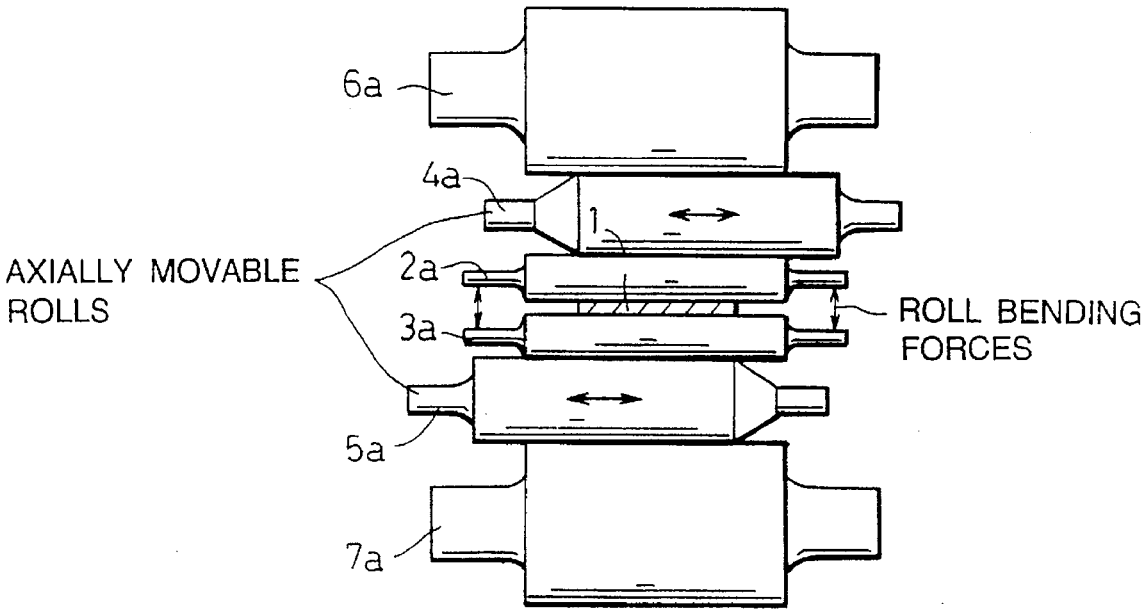
FIG. 3 is a schematic view of a second rolling mill (an HC mill) shown in FIG. 1.

In FIG. 1, a tandem mill system of this embodiment is constructed such that first type rolling mills 8 to 11, each being shown in FIG. 2, are arranged in the upstream side of from first to fourth stands, and second type rolling mills 12 to 14, each being shown in FIG. 3, are arranged in the downstream side of from fifth to seventh stands. A strip 1 to be rolled is supplied from the entry side of the first type rolling mills 8 to 11 and successively rolled through the two types rolling mills, including the second type rolling mills 12 to 14, in tandem.

The first type rolling mills 8 to 11 each comprise, as shown in FIG. 2, a pair of upper and lower work rolls 2, 3 and a pair of upper and lower back-up rolls 6, 7. The first type rolling mill is of a crossing mill that the pair of work rolls 2, 3 are inclined with respect to the pair of back-up rolls 6, 7 respectively supporting the work rolls 2, 3 and also crossed each other in respective horizontal planes to control the transverse thickness distribution, i.e., the strip crown. In this specification, such a crossing mill will be referred to as "a work roll crossing mill" case by case. Further, this work roll crossing mill includes a lubricant supply device (described later) for lubricating between the work rolls 2, 3 and the back-up rolls 6, 7 so that thrust forces produced between the work rolls 2, 3 and the back-up rolls 6, 7 in the axial directions of the roll because of only the work rolls 2, 3 being crossed are reduced. Additionally, a cross angle of the work rolls may be controlled even during the rolling in which the strip is passing the mill. This is because a screwdown force of a screwdown device is applied to back-up roll chocks 204 (see FIG. 4), but not directly applied to work roll chocks 203 (see FIG. 4), allowing the work rolls to easily incline even during the rolling. Thus, during passing cross angle control is permitted. In a later-described PC mill (see FIG. 11), since the back-up roll chocks to which the screwdown force is directly applied are also inclined, it is difficult to control the cross angle during the rolling.

The second type rolling mills 12 to 14 each comprise, as shown in FIG. 3, a pair of upper and lower work rolls 2*a*, 3*a*, a pair of upper and lower intermediate rolls 4*a*, 5*a* movable in the axial direction, and a pair of upper and lower back-up rolls 6*a*, 7*a*. The second type rolling mill is of the so-called HC mill that roll movement of the intermediate rolls 4*a*, 5*a* and bending of the work rolls 2*a*, 3*a* are combined to control the transverse thickness distribution, thereby controlling the strip crown and shape (flatness). In this HC mill, the intermediate rolls 4*a*, 5*a* are moved in the axial direction and the back-up rolls 6*a*, 7*a* serve to support the intermediate rolls 4*a*, 5*a*. Note that the HC mill is not limited to the type axially moving the intermediate rolls and, as an alternative, it may be the type axially moving the work rolls or the type axially moving the back-up rolls.

The diameter of the work rolls is usually the same throughout all the stands. In this embodiment, however, the diameter of the work rolls in the downstream second type rolling mills 12 to 14 is set smaller than that in the upstream first type rolling mills 8 to 11. The reason is that with the work rolls having a smaller diameter, a work roll bending effect is more concentrically applied to the strip ends and a capability of correcting the quarter buckle is enhanced.

The detailed structure of the work roll crossing mill used in each of the first type rolling mills 8 to 11 will now be explained with reference to FIGS. 4 and 5.

Figure 4:
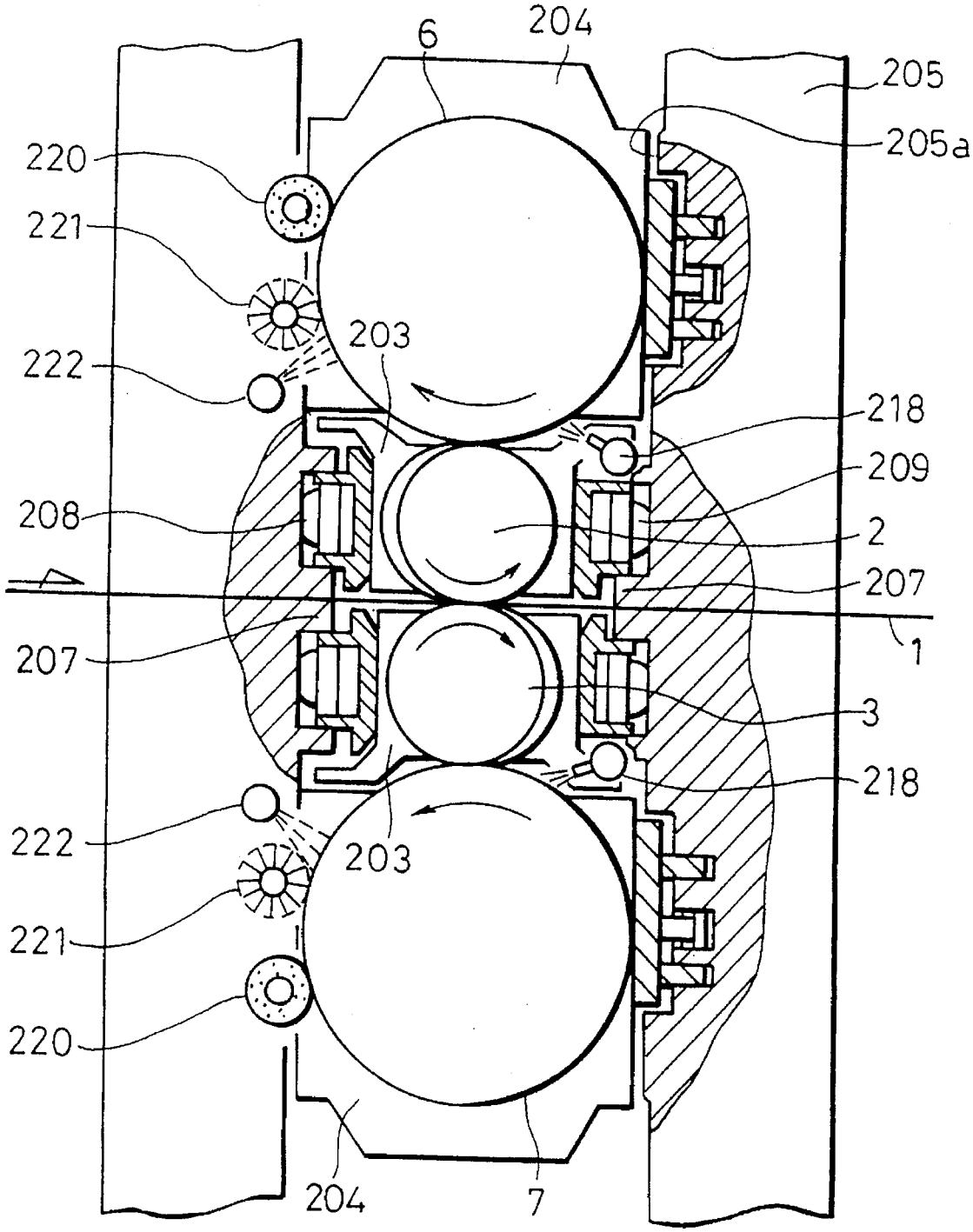
FIG. 4 is a front view, partly sectioned, of the work roll crossing mill shown in FIG. 2.

In FIG. 4, the work roll crossing mill comprises, as mentioned above, the pair of upper and lower work rolls 2, 3 and the pair of upper and lower back-up rolls 6, 7 supporting the associated work rolls. Work roll chocks 203 are provided at respective roll ends of the work rolls 2, 3 and rotatably support the work rolls 2, 3. Likewise, back-up roll chocks 204 are provided at respective roll ends of the back-up rolls 6, 7 and rotatably support the back-up rolls 6, 7.

The work roll chocks 203 and the back-up roll chocks 204 are disposed to face respective window surfaces 205*a* of a pair of stands 205 which are vertically installed with a distance in the axial direction of the mill rolls. A screwdown jack (not shown) provided in upper or lower portions of the stands 205 applies reduction force to the work and back-up rolls for rolling the strip 1.

Hydraulic jacks 208, 209 are provided in respective projecting blocks 207 of the stands 205 facing both lateral surfaces of the work roll chock 203 so that roll axes of the pair of upper and lower work rolls 2, 3 can be inclined with respect to roll axes of the pair of back-up rolls 6, 7 and also crossed each other, thereby making only the work rolls 2, 3 crossed in respective horizontal planes.

Figure 5:
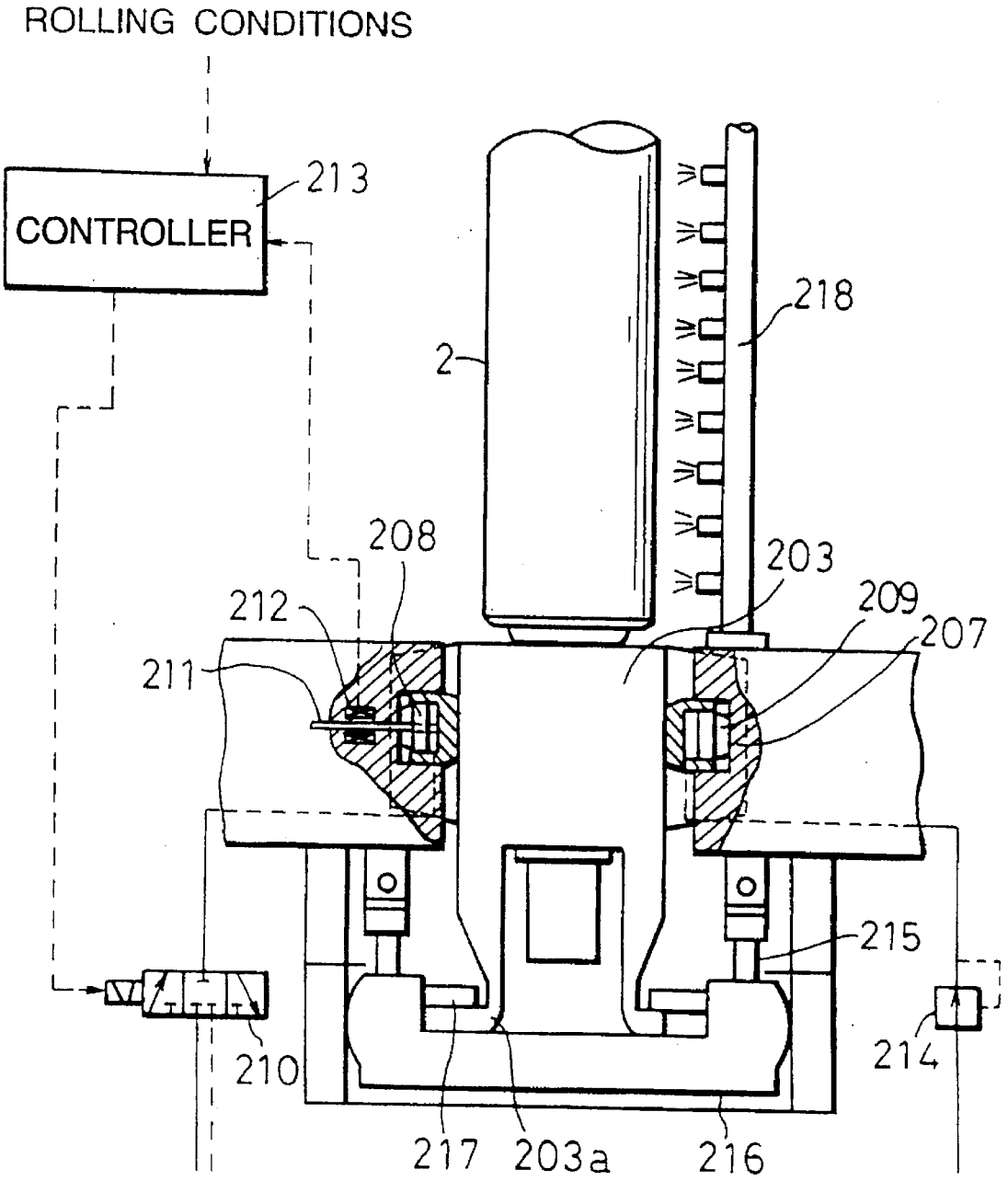
FIG. 5 is a top plan view, partly sectioned, of the work roll crossing mill shown in FIG. 4.

FIG. 5 shows a hydraulic system for driving the hydraulic jacks 208, 209 to actuate. A hydraulic fluid is supplied to the hydraulic jack 208 via a directional control valve 210, and an amount through which a hydraulic ram of the hydraulic jack 208 has moved is detected by sensing a displacement of a rod 211 attached to the hydraulic ram by a sensor 212, the detected signal being transmitted to a work roll cross angle controller 213. The work roll cross angle controller 213 calculates a desired cross angle of the work rolls 2, 3 based on signals corresponding to rolling conditions, calculates a target amount of movement of the hydraulic ram necessary for achieving the desired cross angle, and then regulates the directional control valve 210 to drive the hydraulic jack 208 so that the detected amount of movement coincides with the target amount of movement. Through such feedback control, the cross angle of the work rolls 2, 3 is controlled to a desired value. This cross angle control may be performed not only while any strip is not passing the mill, but also during the rolling in which the strip is passing the mill, as mentioned before. Thus, during passing cross angle control is performed. The controller 213 has a function of controlling the cross angle even during the rolling of the strip.

The hydraulic fluid is supplied to the hydraulic jack 209 via a pressure reducing valve 214 so that the work roll chock 203 is pressed with a proper pressing force.

Also, to enable each of the work rolls 2, 3 to move in the axial direction thereof, two hydraulic cylinders 215, 215 for driving the work roll along its roll axis are provided on the stand 205 in sandwich relation to the work roll chock 203. These hydraulic cylinders 215, 215 have rods coupled to a common movable block 216, and releasable locking portions 217 provided on the movable block 216 engage projections 203*a* formed at an end of the work roll chock 203, whereby driving forces of the hydraulic cylinders 215, 215 are transmitted to the work roll chock 203 to move the work roll 2 or 3 in the axial direction.

It is needless to say that, though not shown, the above-mentioned control of axial movement of the work rolls 2, 3 is performed by a movement amount controller depending on rolling conditions.

Further, as shown in FIGS. 4 and 5, lubricant supply nozzles 218 are disposed along the roll axis as a primary member of a lubricant supply device for supplying a lubricant to between the work rolls 2, 3 and the back-up rolls 6, 7. The position where the lubricant supply nozzle 218 is disposed is not necessarily limited to the illustrated location, and may be at any location so long as lubricating oil as a lubricant can be supplied to between both the rolls.

A roll grinder 220 is installed closely to the roll surface of each of the back-up rolls 6, 7 for grinding the roll surface during the rolling. A brush roller 221 and a cleaning nozzle 222 are also installed to remove the lubricating oil that has adhered onto the roll surface of each of the back-up rolls 6, 7.

In the work roll crossing mill of this embodiment, as mentioned above, the lubricant supply nozzle 218 is disposed along the roll axis for supplying a lubricant to between the work rolls 2, 3 and the back-up rolls 6, 7. This supply of the lubricant reduces the coefficients of friction between the work rolls 2, 3 and the back-up rolls 6, 7, makes smaller thrust forces produced on the work rolls because of only the work rolls being crossed, and further successfully enables easy change of the strip crown during the rolling while providing a high capability of strip crown control. As a result, there can be realized a 4-high mill of the type that only the work rolls are crossed each other. Incidentally, the detailed operation of this type 4-high mill is described in Japanese Patent Application No. 3-66007.

In addition, since the upper and lower work rolls 2, 3 are arranged so as to shift in the axial direction, the work rolls can be axially moved during the rolling operation, which enables dispersion of wear and hence schedule free rolling.

A description will now be given of operating advantages of this embodiment.

In usual rolling schedule, a reduction rate of the first stand is maximum. Accordingly, if the large strip crown is given in the first stand, it becomes difficult to correct that strip crown in the subsequent stands. Stated otherwise, those rolling mills which have a high capability of correcting the strip crown are required to be installed in the upstream side including the first stand. In the case of hot rolling, since rolls are brought into contact with strips at high temperatures in several upstream stands, small-diameter rolls are heated up to high temperatures soon because of their small heat capacity and the quality of roll material is deteriorated. Also, if work rolls of upstream stands have a small diameter, those work rolls cannot bite a thick strip therebetween. For that reason, large-diameter work rolls are required in upstream stands of the tandem mill system. A 6-high HC mill having large-diameter work rolls, however, becomes an extremely large-sized apparatus and increases the construction cost. Still another drawback is in that because of being less susceptible to bending, large-diameter work rolls have a small roll bending effect and hence exhibit a small capability of controlling the strip crown and so forth.

Furthermore, in the case of hot rolling, rolls are brought into contact with strips at high temperatures in several upstream stands and the roll surface inevitably changes in quality such that the so-called scale is created thereon. Taking the fact into account, it has been practiced to intentionally or positively deposit the scale as one kind of surface coating. The scale is very hard and no particular problems arise if it is uniformly deposited over the roll surface. However, deposition of the scale onto the roll surface is not so stable in its creation process immediately after roll replacement that the scale once deposited is often peeled off and caught up between the roll and the strip, thereby causing a scratch. Accordingly, roll replacement is required and time loss necessary for the roll replacement leads to a reduction in production efficiency. Moreover, the necessity of rolling those strips, which especially tend to create the scale, immediately after roll replacement has imposed limitations on the degree of freedom in schedule.

On the other hand, in the downstream stands where the strip thickness is small, a transverse deformation at the strip ends is small and flatness at the strip ends becomes a critical factor. Therefore, those rolling mills which have a high capability of correcting the strip end shape are required to be installed in the downstream stands.

In this embodiment, the work roll crossing mills are used as the first type rolling mills 8 to 11 arranged in the upstream side of the tandem mill system and their roll crossing effects are utilized to control the transverse thickness distribution, i.e., the strip crown, ranged from the vicinity of the strip center. In this connection, since the work roll crossing mill can control the cross angle during the rolling, it is possible to control the strip crown in real time while detecting the strip shape. The HC mills are used as the second type rolling mills 12 to 14 arranged in the downstream side to concentrically correct the strip end shape based on both the roll movement and the work roll bending. Consequently, a high capability of quarter buckle control can be developed by a combination of two kinds of shape control functions which provide different influences upon the transverse thickness distribution pattern of the strip.

Since large-diameter work rolls are used in the work roll crossing mills as the first type rolling mills 8 to 11, the work rolls are prevented from being heated up to high temperatures and deterioration of the roll material can be suppressed. Additionally, the use of large-diameter work rolls can ensure positive biting of thick strips.

Moreover, in the work roll crossing mills used as the first type rolling mills 8 to 11 arranged in the upstream side of the tandem mill system, since the work rolls 2, 3 are rotated in such a condition that they are inclined with respect to the back-up rolls 6, 7 supporting the work rolls 2, 3 and simultaneously crossed each other in respective horizontal planes, there occur slight slips between the work roll 2 and the back-up roll 6 and between the work roll 3 and the back-up roll 7, causing the rolls 2, 3 and 7, 8 to grind each other. As a result, the roll surfaces are always kept clean and scratches due to the scale are not caused.

With this embodiment, as explained above, there can be provided a tandem mill system which has a high capability of correcting the quarter buckle while ensuring positive biting of strips. Also, the roll surfaces are always kept free from scratches and transfer of scratches to the strip is reduced to a large extent, with the result of a remarkable improvement in yield. Additionally, since roll wear is made uniform, time loss necessary for roll replacement is reduced and production efficiency is increased.

While the present invention is applied to hot rolling in this embodiment, the similar construction may also applied to cold rolling with the result of the similar advantage in relation to a capability of correcting the quarter buckle. Although the problem of scale does not exist in cold rolling, the similar roll grinding effect in the crossing mill is obtained for scratches caused on the roll surfaces and strips, whereby yield and production efficiency are improved.

Figure 14:
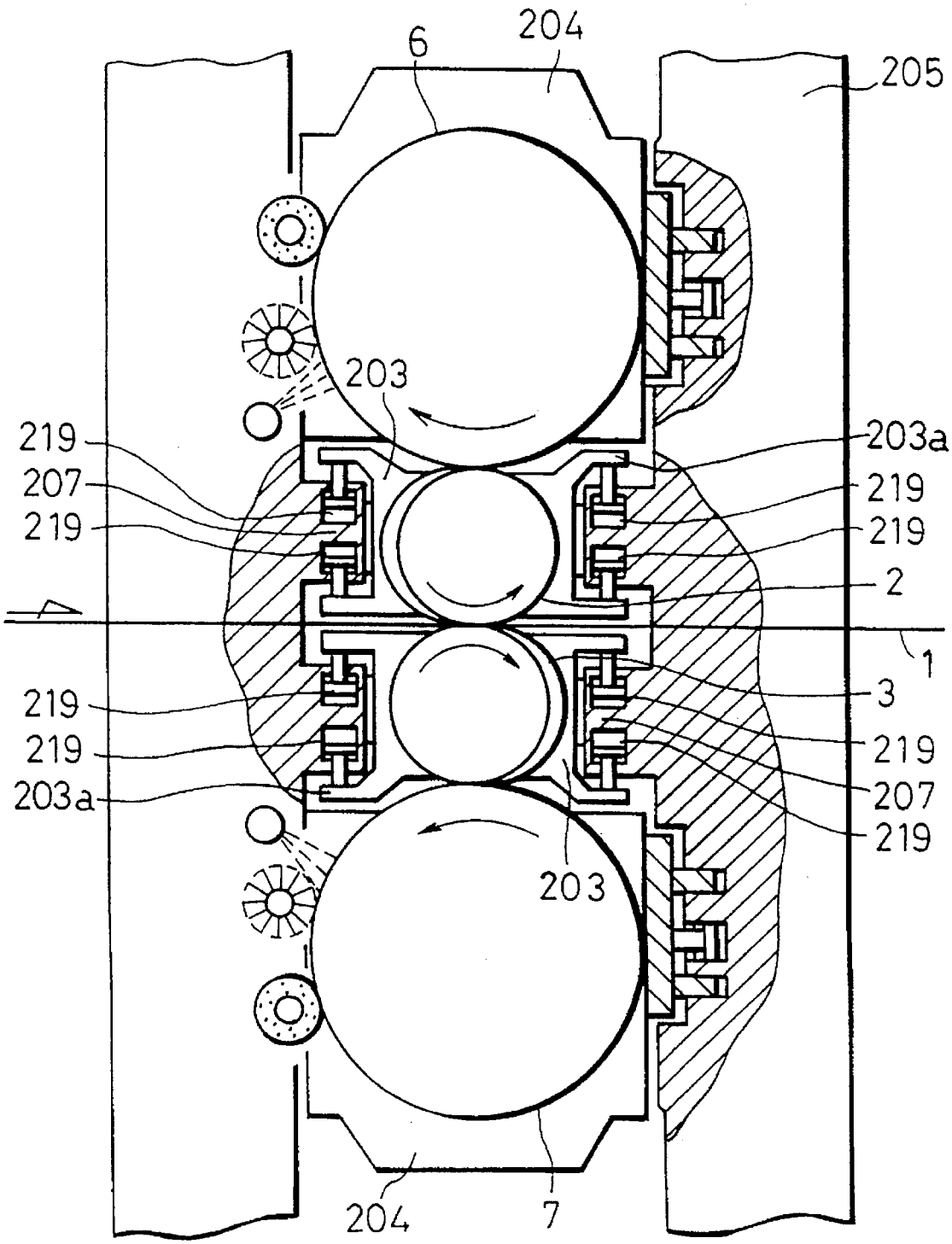
FIG. 14 is a front view, partly sectioned, of a work roll crossing mill with a work roll bending function.

As to the work roll crossing mills used as the first type rolling mills 8 to 11, no descriptions are made about applying bending forces to the work rolls. As shown in FIG. 14 explained later, however, there may be provided means for applying bending forces to the work rolls.

Figure 6:
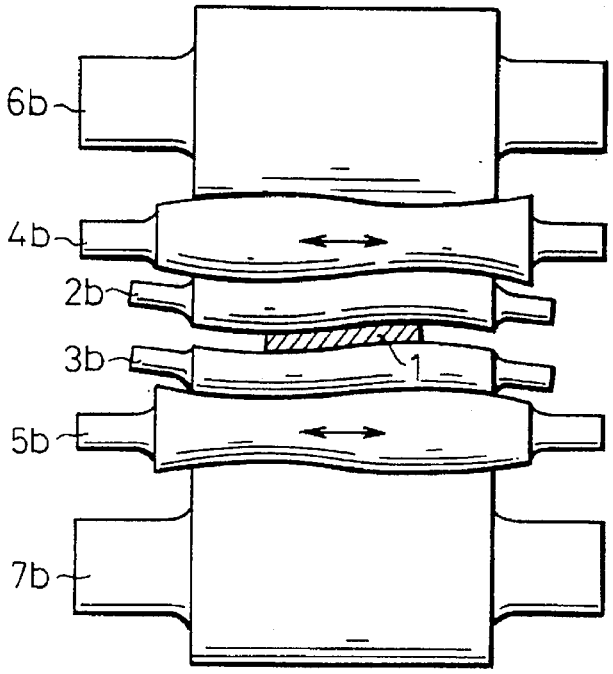
FIG. 6 is a schematic view of a 6-high mill having modified rolls which is arranged in place of the HC mill shown in FIG. 1.
Figure 7:
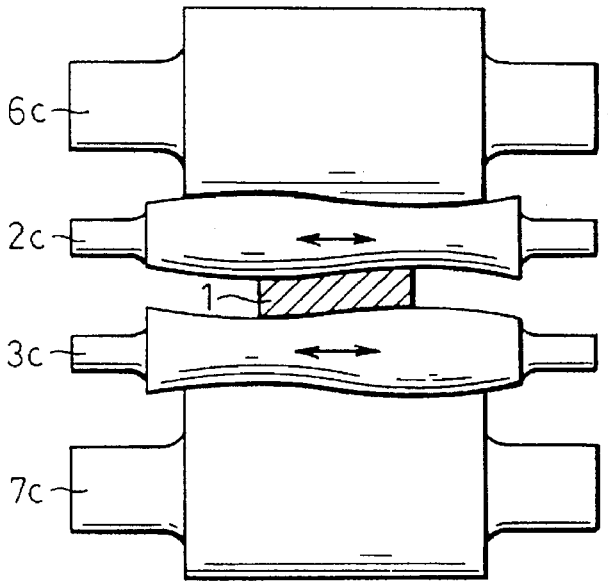
FIG. 7 is a schematic view of a 4-high mill having modified rolls which is arranged in place of the HC mill shown in FIG. 1.

Rolling mills having bottle shape rolls, as shown in FIGS. 6 and 7, have recently been developed and these mills may be used as the downstream second type rolling mills 12 to 14 in place of the HC mills. FIGS. 6 and 7 show examples of the rolling mills with modified rolls. The rolling mill shown in FIG. 6 comprises a pair of upper and lower work rolls 2*b*, 3*b*, a pair of upper and lower intermediate rolls 4*b*, 5*b*, and a pair of upper and lower back-up rolls 6*b*, 7*b*. The intermediate rolls 4*b*, 5*b* have bottle shapes mutually symmetrical about a point and are movable in the axial direction thereof. The transverse thickness distribution of the strip is controlled by moving the pair of intermediate rolls 4*b*, 5*b* in opposite directions to each other. The rolling mill shown in FIG. 7 comprises a pair of upper and lower work rolls 2*c*, 3*c* and a pair of upper and lower back-up rolls 6*c*, 7*c*. The work rolls 6*c*, 7*c* have bottle shapes mutually symmetrical about a point and are movable in the axial direction thereof. The transverse thickness distribution of the strip is controlled by moving the pair of work rolls 6*c*, 7*c* in opposite directions to each other. These rolling mills with modified rolls also have a function of concentrically correcting the strip end shape by axial movement of the bottle shape rolls. Accordingly, by arranging those rolling mills with modified rolls in the downstream stands, there can be developed a high capability of quarter buckle control similarly to the embodiment shown in FIG. 1. It should be noted that in later-described embodiments, too, the rolling mills with modified rolls shown in FIGS. 6 and 7 can be likewise used in place of the HC mills.

SECOND EMBODIMENT

Figure 8:
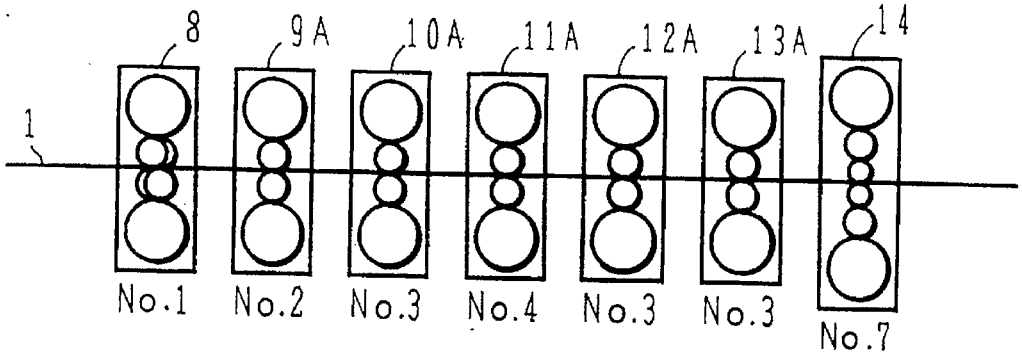
FIG. 8 is a schematic view of a tandem mill system according to a second embodiment of the present invention.

A second embodiment of the present invention will be described with reference to FIG. 8. This embodiment also represents the case where the present invention is also applied to hot rolling. In this embodiment, the work roll crossing mill shown in FIG. 2 is arranged as the first type rolling mill 8 in the first stand, the HC mill shown in FIG. 3 is arranged as the second type rolling mill 14 in the final seventh stand, and conventional 4-high mills 9A to 13A with no rolls crossed are arranged in the intermediate second to sixth stands.

As mentioned before, in usual rolling schedule, a reduction rate of the first stand is maximum and, if the large strip crown is given in the first stand, it becomes difficult to correct that strip crown in the subsequent stands. Accordingly, it is required to install in the first stand that rolling mill which has a high capability of correcting the strip crown and also which is large in work roll diameter and has a function of keeping the roll surfaces clean, from the above-mentioned reasons. Further, in the final stand where the strip thickness is small, a transverse deformation at the strip ends is small and flatness at the strip ends becomes a critical factor. Therefore, that rolling mill which has a high capability of correcting the strip end shape is required to be installed in the final stand. No particular problems arise even with conventional rolling mills used in the intermediate stands.

This embodiment is on the basis of the above consideration. More specifically, the work roll crossing mill and the HC mill are arranged in the first stand and the final seventh stand, respectively, so that the first stand controls the transverse thickness distribution, i.e., the strip crown, ranged from the vicinity of the strip center based on the roll crossing effect and the final stand concentrically corrects the strip end shape based on both the roll movement and the work roll bending, thereby making it possible to develop a high capability of quarter buckle control. This embodiment can also provide the similar advantages to those in the embodiment of FIG. 1 such as that the work roll crossing mill in the first stand causes no scratches on the rolls and strips. Additionally, this embodiment can also be applied to cold rolling with the result of the similar advantages in relation to a capability of quarter buckle control and a reduction in the occurrence of scratches.

THIRD EMBODIMENT

Figure 9:
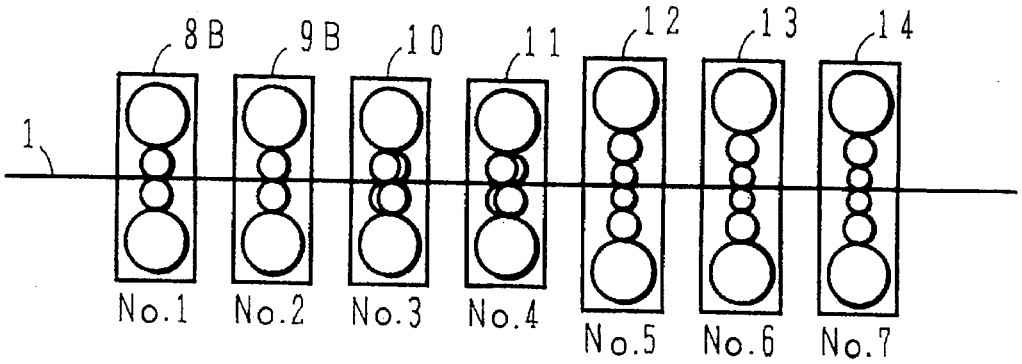
FIG. 9 is a schematic view of a tandem mill system according to a third embodiment of the present invention.

A third embodiment of the present invention will be described with reference to FIG. 9. This embodiment also represents the case where the present invention is applied to hot rolling. In this embodiment, the work roll crossing mills, each being shown in FIG. 2, are arranged as the first type rolling mills 10, 11 in the upstream third and fourth stands, the HC mills, each being shown in FIG. 3, are arranged as the second type rolling mills 12 to 14 in the downstream fifth to seventh stands, and conventional 4-high mills 8B, 9B with no rolls crossed are arranged in the upstream first and second stands.

As mentioned before, the scale deposits on the work rolls in the upstream stands. If the scale deposits uniformly in the axial direction, no particular problems arise; on the contrary, it is rather preferable in many cases. The scale is a hard metal oxide and has advantageous features such as high wear resistance. Therefore, the first and second stands in which the scale is more likely to deposit on the work rolls are constituted by the conventional 4-high mills, with an intention of positively depositing the scale to improve wear resistance. From the third stand in which deposition of the scale tends to be unstable, the work roll crossing mills, each being shown in FIG. 2, are arranged until the fourth stand so that the occurrence of roll scratches is prevented by utilizing the grinding effect based on the roll crossing.

A reduction in capability of strip crown control caused by the conventional 4-high mills 8B, 9B arranged in the first and second stands is compensated for by the work roll crossing mills 10, 11 in the third and fourth stands. As a result, a high capability of strip crown control can be developed through the entirety of the upstream first to fourth stands.

Consequently, this embodiment can also provide the similar advantages to those in the foregoing embodiments.

Figure 10:
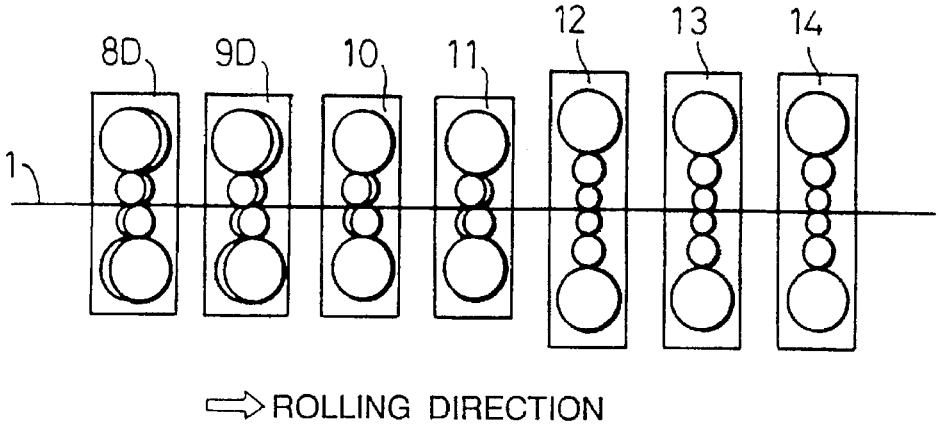
FIG. 10 is a schematic view of a tandem mill system according to a modification of the third embodiment shown in FIG. 9.
Figure 11:
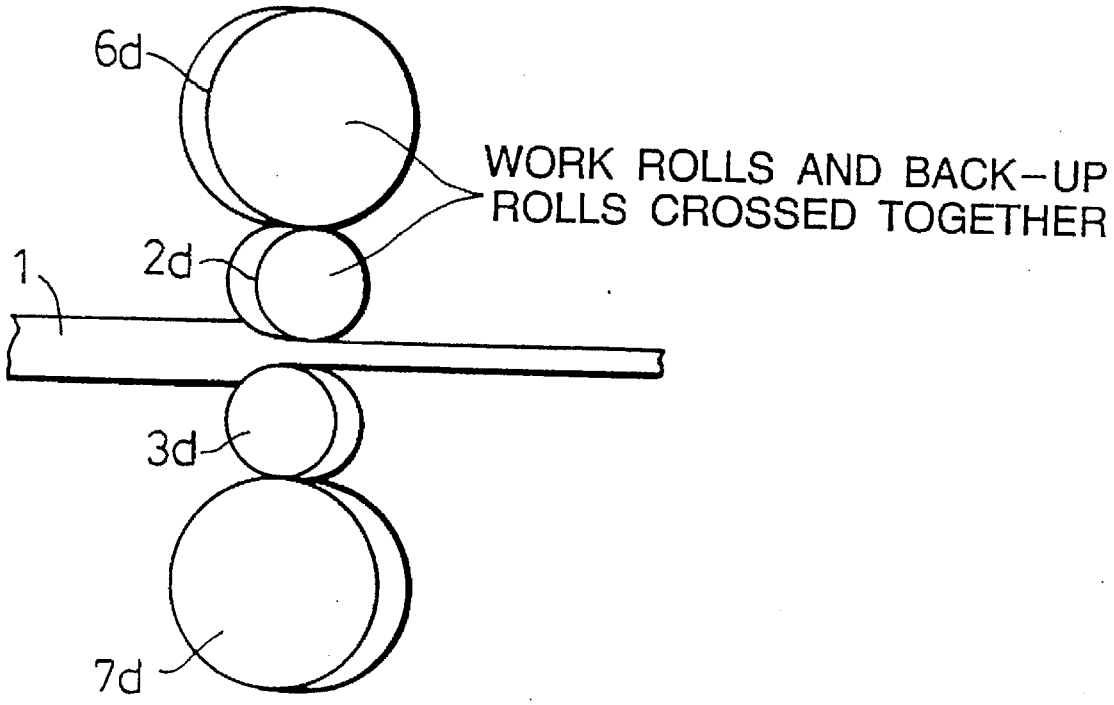
FIG. 11 is a schematic view of a PC mill shown in FIG. 10.

In the above-mentioned third embodiment, the first and second stands may be constituted by rolling mills of the type that pairs of work rolls and back-up rolls, one pair being on each of the upper and lower sides, are crossed together each other in respective horizontal planes, i.e., PC mills, other than the conventional 4-high mills. This alternative arrangement is shown in FIG. 10. In FIG. 10, PC mills 8D, 9D are arranged in the first and second stands. As shown in FIG. 11, the PC mills each comprise a pair of work rolls 2*d*, 3*d* and a pair of back-up rolls 6*d*, 7*d* arranged such that the pair of work rolls 2*d*, 3*d* and the pair of back-up rolls 6*d*, 7*d* supporting the work rolls 2*d*, 3*d* are crossed together each other in respective horizontal planes, thus controlling the transverse thickness distribution of the strip. The arrangement of FIG. 10 using the PC mills can also provide the similar advantages to those in the third embodiment.

FOURTH EMBODIMENT

Figure 12:
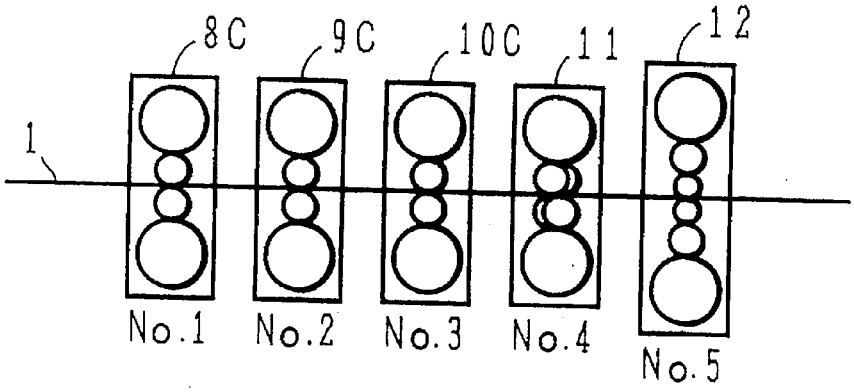
FIG. 12 is a schematic view of a tandem mill system according to a fourth embodiment of the present invention.

A fourth embodiment of the present invention will be described with reference to FIG. 12. This embodiment represents an arrangement which is primarily used in cold rolling. In this embodiment, the work roll crossing mill shown in FIG. 2 is arranged as the first type rolling mill 11 in the fourth stand before the final stand, the HC mill shown in FIG. 3 is arranged as the second type rolling mill 12 in the final fifth stand, and conventional 4-high mills 8C to 10C with no rolls crossed are arranged in the upstream first to third stands.

In cold rolling, a capability of correcting the shape (flatness) is required rather than a capability of correcting the strip crown. For strips of large width, particularly, there is needed a capability of correcting the quarter buckle including not only simple end and middle elongations, but also mixture of these elongations. As mentioned before, such a capability is provided by properly combining a means which gives an influence upon the transverse thickness distribution pattern ranged from the vicinity of the strip center and a means which concentrically applies an effect to the strip ends. The shape of final rolled products is greatly influenced by the final n-th stand (the fifth stand in the case Of FIG. 12) and the preceding (n−1)-th stand (the fourth stand in the case of FIG. 12). Therefore, the work roll crossing mill shown in FIG. 2 which gives an influence upon the transverse thickness distribution pattern ranged from the vicinity of the strip center is arranged in the (n−1)-th stand, and the HC mill shown in FIG. 3 which concentrically applies an effect to the strip ends is arranged in the final n-th stand. Thus, the different effects of those mills are properly combined with each other to correct the quarter buckle. Of course, the above arrangement may be reversed such that the HC mill shown in FIG. 3 is arranged in the (n−1)-th stand and the work roll crossing mill shown in FIG. 2 is arranged in the final n-th stand.

This embodiment can also increase a capability of correcting the quarter buckle similarly to the first embodiment. Further, with the provision of the work roll crossing mill, the roll grinding effect can be obtained to provide advantages of improving both yield and production efficiency.

FIFTH EMBODIMENT

A fifth embodiment of the present invention will be described with reference to FIGS. 13 to 16. This embodiment also represents an arrangement which is primarily used in cold rolling. In this embodiment, work roll crossing mills with a work roll bending function are arranged as first type rolling mills 8E to 11E in the upstream first to fourth stands in the first embodiment of FIG. 1, and PC mills with a work roll bending function are arranged, in place of the HC mills, as the second type rolling mills 12E to 14E in the downstream fifth to seventh stands.

Figure 15:
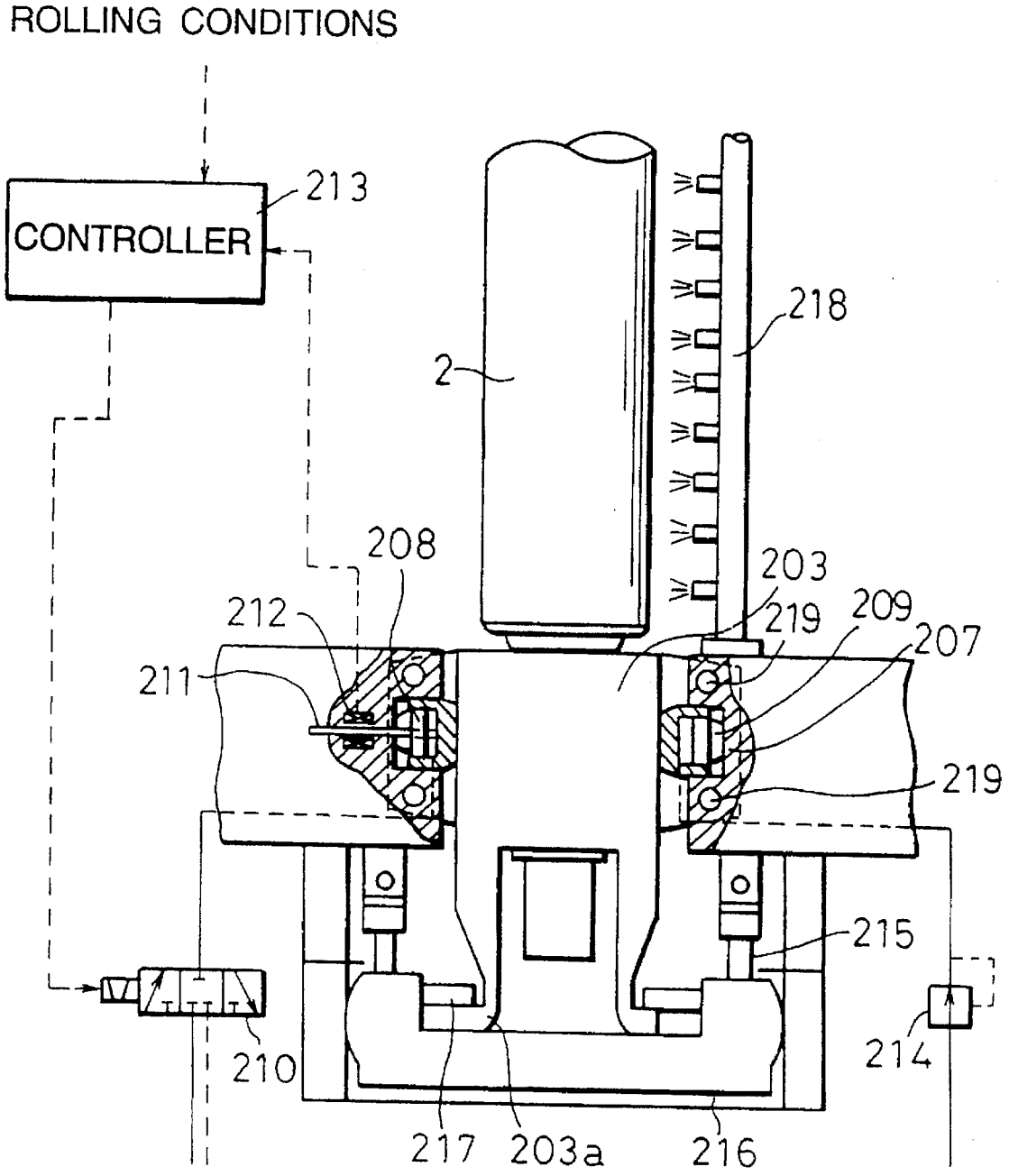
FIG. 15 is a top plan view, partly sectioned, of the work roll crossing mill shown in FIG. 14.

The structure of the work roll crossing mill with a work roll bending function is shown in FIGS. 14 and 15. In these figures, identical members to those shown in FIGS. 4 and 5 are denoted by the same reference numerals. As shown in FIGS. 14 and 15, cylinders 219, 219 for applying bending forces to the work rolls 2, 3 are built in the projecting block 207 in sandwich relation to the hydraulic jacks 208, 209. These cylinders 219, 219 act on flange portions 203 of the work roll chock 203 protruding toward the opposite stands for producing a convex or concave roll-to-roll gap profile.

Although the PC mill with a work roll bending function is not shown, it includes means for applying bending forces as with the work roll crossing mill mentioned above.

Figure 13:
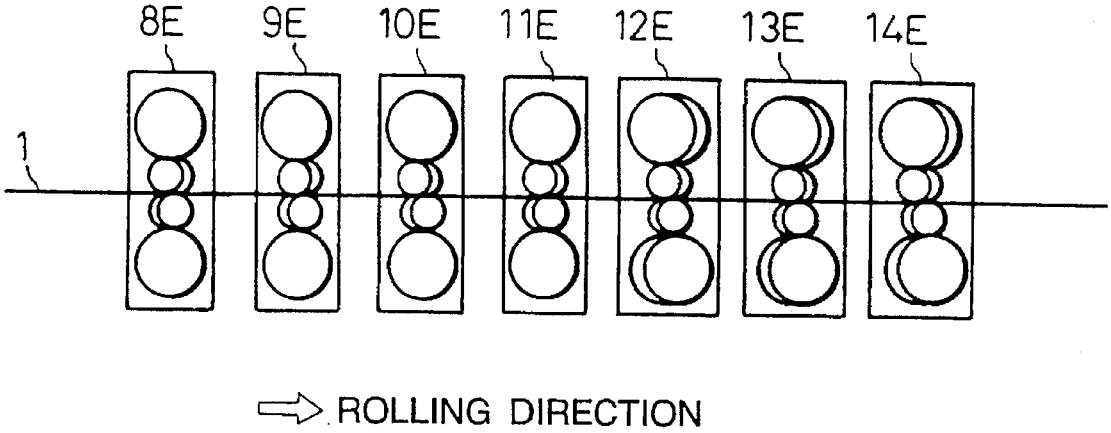
FIG. 13 is a schematic view of a tandem mill system according to a fifth embodiment of the present invention.
Figure 16:
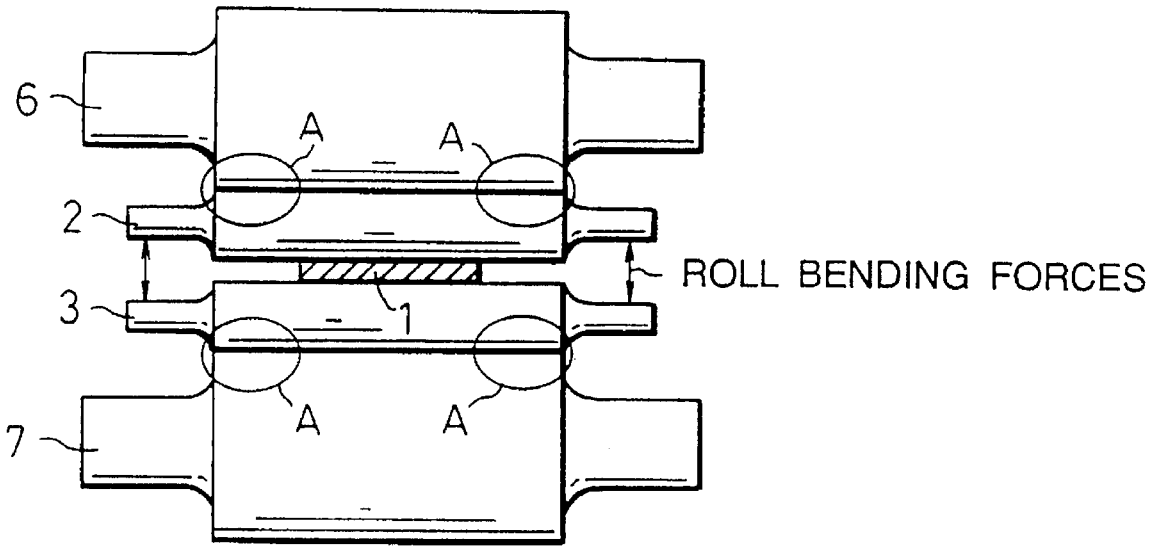
FIG. 16 is a view for explaining detrimental contact portions in roll bending.

To correct the quarter buckle, as stated before, there are needed two or more kinds of shape correcting means which provide different influences upon the transverse thickness distribution pattern. In the case of using large-diameter work rolls, the influence due to roll crossing and the influence due to work roll bending are almost equal to each other, whereby the effect of correcting the quarter buckle is not expected. However, when the roll diameter is small, influences imposed by the work roll bending upon the transverse thickness distribution pattern are different between the work roll crossing mill and the PC mill. More specifically, in the PC mill, detrimental contact portions acting to impede the work roll bending effect are present, as shown in FIG. 16, similarly to the conventional 4-high mill and the work rolls are prevented from bending by forces applied from those detrimental contact portions. On the other hand, in the work roll crossing mill, since the work rolls are crossed with respect to the back-up rolls, the forces from the detrimental contact portions apply obliquely to the work rolls rather than vertically in the PC mill. The work roll bending effect is impeded by the vertical components of the applied forces and, in the work roll crossing mill, the vertical components of the applied forces are somewhat reduced corresponding to inclination of the applied forces. When the work roll diameter is large, a difference in bending due to the difference of the vertical components is small, but the difference in bending is increased as the diameter becomes smaller. Thus, in the case of using small-diameter work rolls, there occurs a difference in work roll bending characteristics between the work roll crossing mill and the PC mill. As a result, by arranging the work roll crossing mills and the PC mills as shown in FIG. 13, the quarter buckle can be corrected similarly to the first embodiment.

Consequently, this embodiment is also effective to increase a capability of correcting the quarter buckle, as well as to improve both yield and production efficiency based on the roll grinding effect.

SIXTH EMBODIMENT

Figure 17:
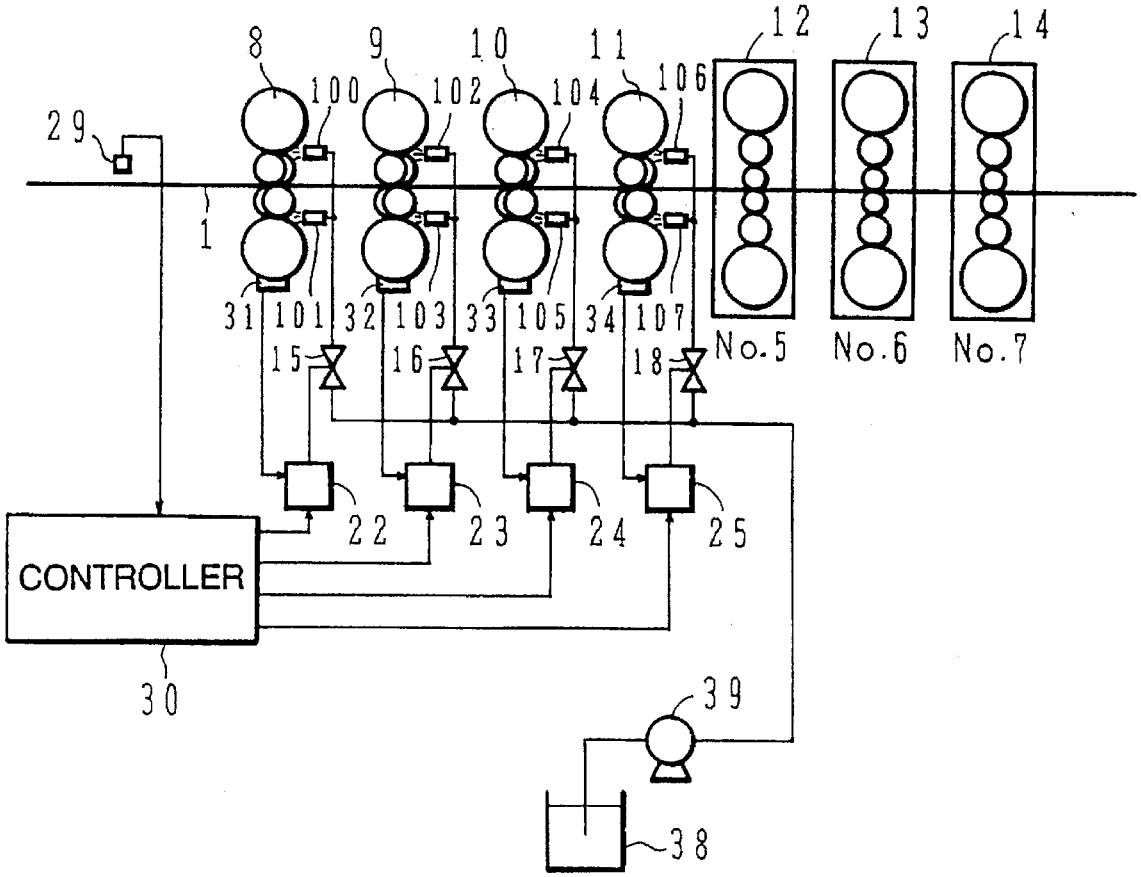
FIG. 17 is a schematic view of a tandem mill system according to a sixth embodiment of the present invention.

FIG. 17 shows a sixth embodiment in which the present invention is applied to hot rolling. This embodiment represents an example of a lubricant supply device in the first embodiment shown in FIG. 1.

In the work roll crossing mill shown in FIG. 2, as mentioned before, since thrust forces are produced between the work rolls 2, 3 and the back-up rolls 6, 7, a lubricant is supplied to the roll-to-roll gap for making the coefficient of friction smaller. However, if the coefficient of friction becomes too small, there occurs a slip when the work rolls are going to bite the strip, which leads to an incapability of the rolling. For this reason, the amount of lubricant supplied is preferable to be as small as possible. It is also preferable to stop supply of the lubricant immediately before biting of the strip and start the supply again after the biting.

In this embodiment of FIG. 17, therefore, the first type rolling mills (work roll crossing mills) 8 to 11 shown in FIG. 1 are associated with a lubricant supply device which comprises valves 15 to 18, nozzles 100 to 107, a tank 38 as a supply source of the lubricant, and a pump 39. The valves 15 to 18 of the lubricant supply device are controlled by supply amount adjusters 22 to 25 and a controller 30. A strip sensor 29 is provided in the entrance side of a train of the rolling mills to detect the presence or absence of the strip 1. The presence of the strip is usually detected by using a thermometer. Further, load cells 31 to 34 are provided in the respective stands to detect biting of the strip.

When the strip sensor 29 detects that the strip has entered, a detected signal is taken by the controller 30 from which a supply stop signal is immediately transmitted to the supply amount adjuster 22 for the first stand. Threading speeds for the respective stands are previously input in the controller 30 which calculates periods of time required for the strip to pass the stand-to-stand distances and successively transmits supply stop signals to the supply amount adjusters for the subsequent stands with lags corresponding to the calculated periods of time. Meanwhile, the supply of the lubricant must be started again immediately after biting of the strip. To this end, the biting is detected by the load cells 31 to 34 provided on the respective stands, whereupon supply start signals are output to the supply amount adjusters 22 to 25. The lubricant is sent from the tank 38 as a supply source by the pump 39. By so controlling the supply of the lubricant, troubles due to excessive thrust forces and slip troubles at the time of biting are eliminated, with the result of improved production efficiency.

SEVENTH EMBODIMENT

A seventh embodiment of the present invention will be described with reference to FIG. 18. This embodiment is also related to a lubricant supply device as with the above sixth embodiment. Generally, rolling schedule is determined so that rolling power becomes uniform throughout all the stands. Therefore, rolling load is not always on the same order in all the stands. There is such a tendency that rolling load is large in the upstream stands corresponding to a slow threading speed and, to the contrary, it is small in the downstream stands. Because thrust forces produced in the work roll crossing mill are almost proportional to rolling load, the upstream stands undergo larger thrust forces than the downstream stands and require more frequent replacement of the rolls and bearings, meaning that maintenance time has been wasted. This disadvantage can be eliminated by using, in the upstream stands, a lubricant with a greater capability of reducing the friction force than that of a lubricant used in the downstream stands.

Figure 18:
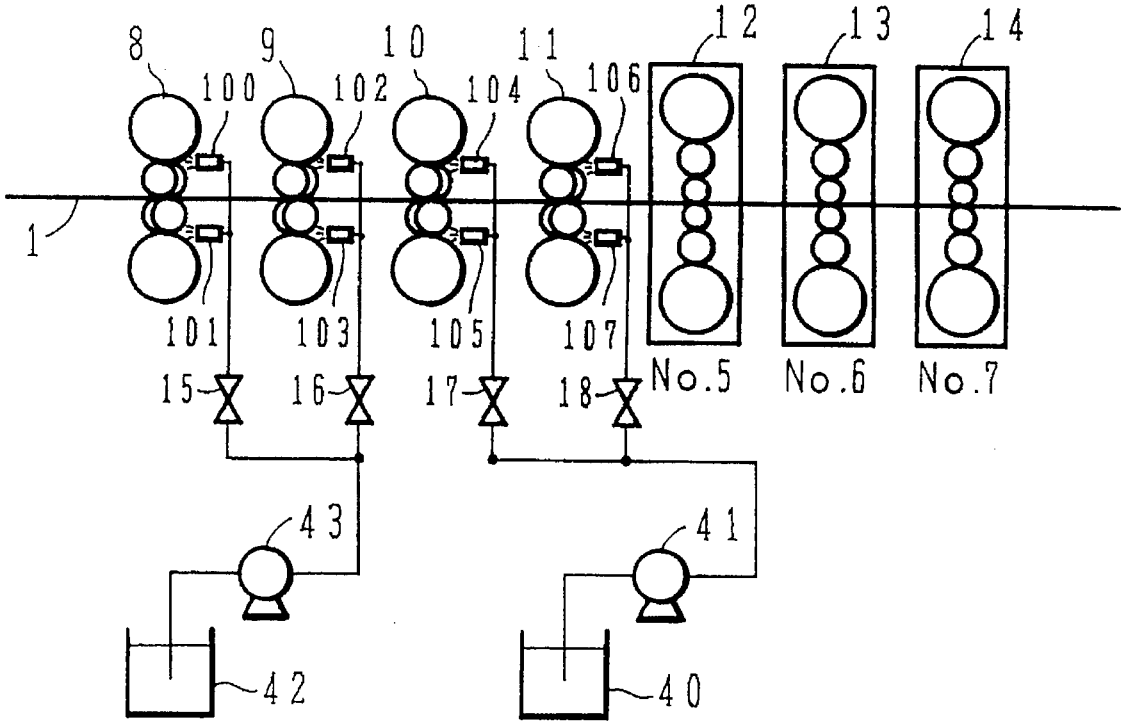
FIG. 18 is a schematic view of a tandem mill system according to a seventh embodiment of the present invention.

In this embodiment of FIG. 18, therefore, the first type rolling mills (work roll crossing mills) 8 to 11 are divided into two groups and, correspondingly to these groups, the lubricant supply device is also divided into two groups. A lubricant with a greater capability of reducing the friction force or a lubricant with higher density is supplied to the first group of upstream work roll crossing mills 8, 9 from a tank 42 by a pump 43, whereas a different lubricant, i.e., a lubricant with a smaller capability of reducing the friction force or a lubricant with lower density is supplied to the second group of upstream work roll crossing mills 10, 11 from a tank 40 by a pump 41. By so supplying two kinds of lubricants, it is possible to make the thrust forces uniform in all the stands, cut down the time wastefully consumed, and hence improve production efficiency. Further, the amount of lubricant used is diminished.

EIGHTH EMBODIMENT

Figure 19:
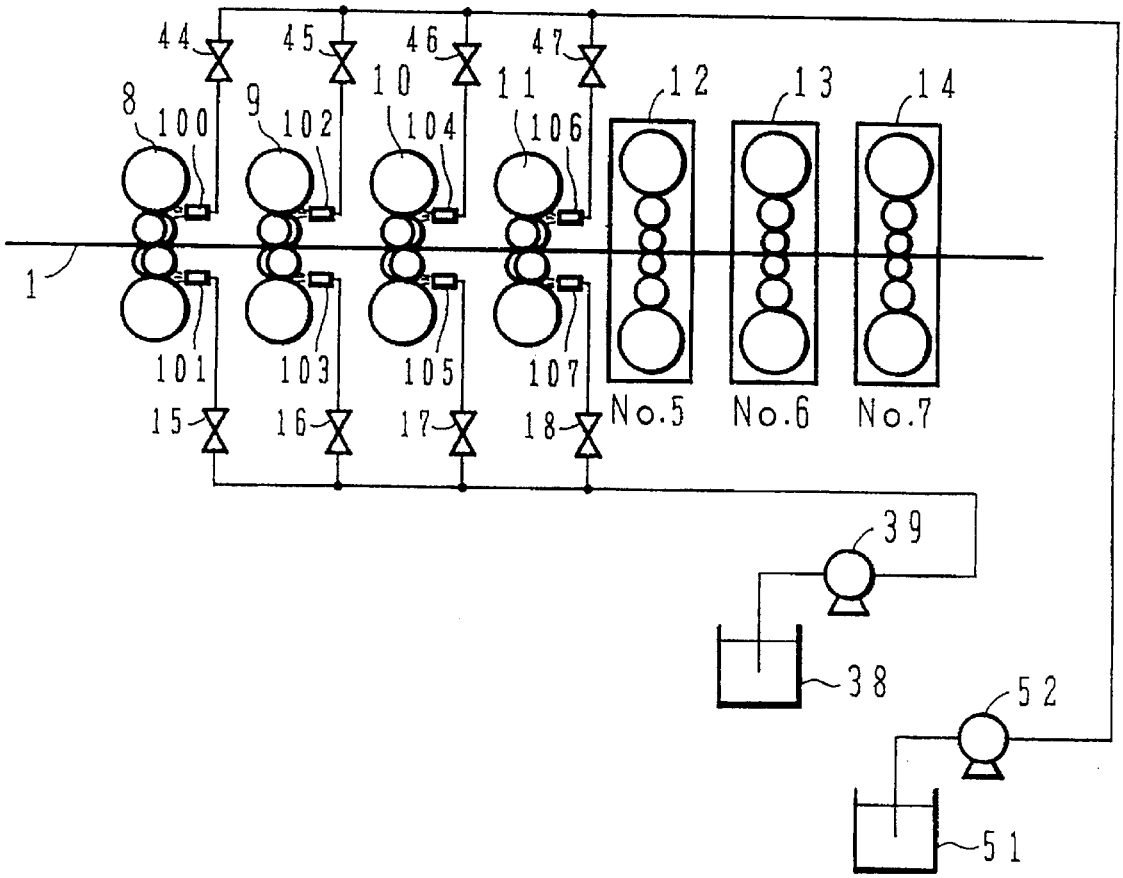
FIG. 19 is a schematic view of a tandem mill system according to an eighth embodiment of the present invention.

An eighth embodiment of the present invention will be described with reference to FIG. 19. This embodiment is also related to a lubricant supply device. In the above embodiments, the same lubricant is supplied to the upper and lower rolls. In many usual cases, however, roll lubricating conditions are different between the upper and lower sides, and roll wears are also different between the upper and lower sides. Generally, since a large amount of cooling water is used in hot rolling, the lubricant is more easily washed away in the lower rolls. Therefore, the coefficient of friction in the lower side is increased and wears of the lower rolls become larger correspondingly.

In view of the above, a lubricant supply system is divided into two lines between the upper rolls and the lower rolls of the rolling mills for supplying lubricants with different densities therethrough. In this embodiment of FIG. 19, valves 44 to 47 and the nozzles 100, 102, 104, 106 are provided as a device for supplying a lubricant to the upper rolls, whereas the valves 15 to 18 and the nozzles 101, 103, 105, 107 are provided as a device for supplying a lubricant to the lower rolls. The lubricant for the upper rolls is supplied to the upper roll system from a tank 51 by a pump 52, and the lubricant with higher density than the lubricant for the upper rolls is supplied to the lower roll system from the tank 38 by the pump 39. By so arranging, it is possible to prevent abnormal wear of the lower rolls, cut down the time wastefully consumed for roll replacement, and hence improve production efficiency.

NINTH EMBODIMENT

A ninth embodiment of the present invention relating to a lubricant supply device divided into plural lines will be described with reference to FIGS. 20 and 21. As shown in FIG. 21, contact pressure between the back-up roll and the work roll is usually distributed such that higher pressure is applied to a roll central portion where the strip is bited, than applied to roll end portions. Accordingly, the friction force is also distributed in the axial direction of the roll such that the greater force is applied to the roll central portion.

In view of the above, nozzles of the lubricant supply device are divided into three groups 110, 111, 112 on the upper side and 113, 114, 115 on the lower side in the axial direction of the roll. A lubricant with higher density and superior lubrication property is supplied to the nozzle groups 100, 113 for the roll central portion subjected to the large friction force, whereas a lubricant with lower density is supplied to the nozzle groups 111, 112 and 114, 115 for the roll end portions. More specifically, the nozzle groups 100, 113 for the roll central portion are commonly connected to a valve 116, a pump 118 and a tank 119 so that the lubricant with higher density is supplied from the tank 119 by the pump 118. The nozzle groups 111, 112 and 114, 115 for the roll end portions are commonly connected to a valve 117, a pump 120 and a tank 121 so that the lubricant with lower density is supplied from the tank 121 by the pump 120.

Of course, as with the foregoing embodiments, the above arrangement may be combined with division of the lubricant supply line between the upper and lower sides or for each group of stands.

The meaning of so dividing the lubricant supply device into plural lines is to reduce the total amount of lubricant used to the extent possible. It is natural that if a lubricant with higher density and superior lubrication property is supplied to all supply spots, the amount of lubricant used would become very large and the production cost of rolled products would be increased correspondingly. For this reason, the lubricant with lower density is supplied as far as practicable to those spots where even the low-density lubricant suffices. As a result, the amount of lubricant used is reduced to a necessary minimum value and a rise in the production cost can be held down.

TENTH EMBODIMENT

Figure 22:
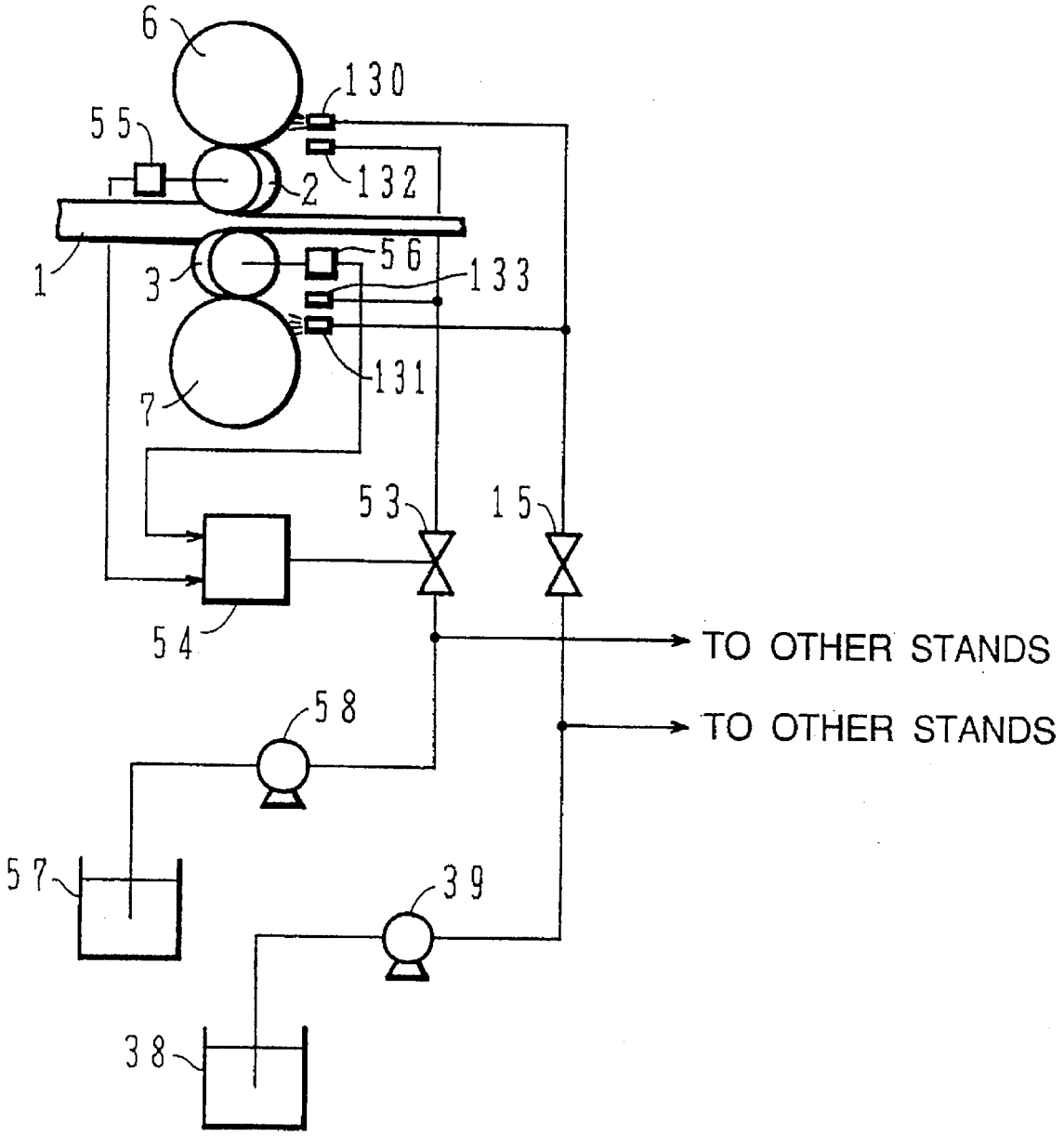
FIG. 22 is a schematic view of a crossing mill according to a tenth embodiment of the present invention.

While the foregoing embodiments have been described as simply dividing the lubricant supply device into plural lines, the lubricant supply device may be divided into plural lines while duplicating them. For example, the lubricant supply device is arranged in such a manner as able to supply two kinds of lubricants with different densities to the same spot through different lines and, when an excessive thrust force is detected, the line for supplying the lubricant with higher density is open to lower the coefficient of friction. FIG. 22 shows an embodiment for practicing the above scheme. In addition to a normal lubricant supply system comprising a line which includes nozzles 130, 131, the valve 15, the pump 39 and the tank 38, there is provided an emergent system comprising a line which includes nozzles 132, 132, a valve 53, a pump 58 and a tank 57. Thrust forces imposed on the work rolls 2, 3 are detected by load cells 55, 56 and output to a supply amount adjuster 54. When the detected thrust forces exceed a certain set value, the supply amount adjuster 54 opens the valve 53 so that the lubricant with higher density in the tank 57 is injected to lower the coefficient of friction. As a result, it is possible to prevent a trouble of roll seizure or the like due to excessive thrust force and hence prolong the service life of the rolls.

OTHER EMBODIMENTS

Still other embodiments of the present invention will be described with reference to FIGS. 23 to 25. In these embodiments shown in FIGS. 23 to 25, the schemes of the embodiments relating to the lubricant supply device shown in FIGS. 17 to 19 are applied to an arrangement in which the work roll crossing mills, each being shown in FIG. 2, are arranged in all the first to seventh stands.

Figure 23:
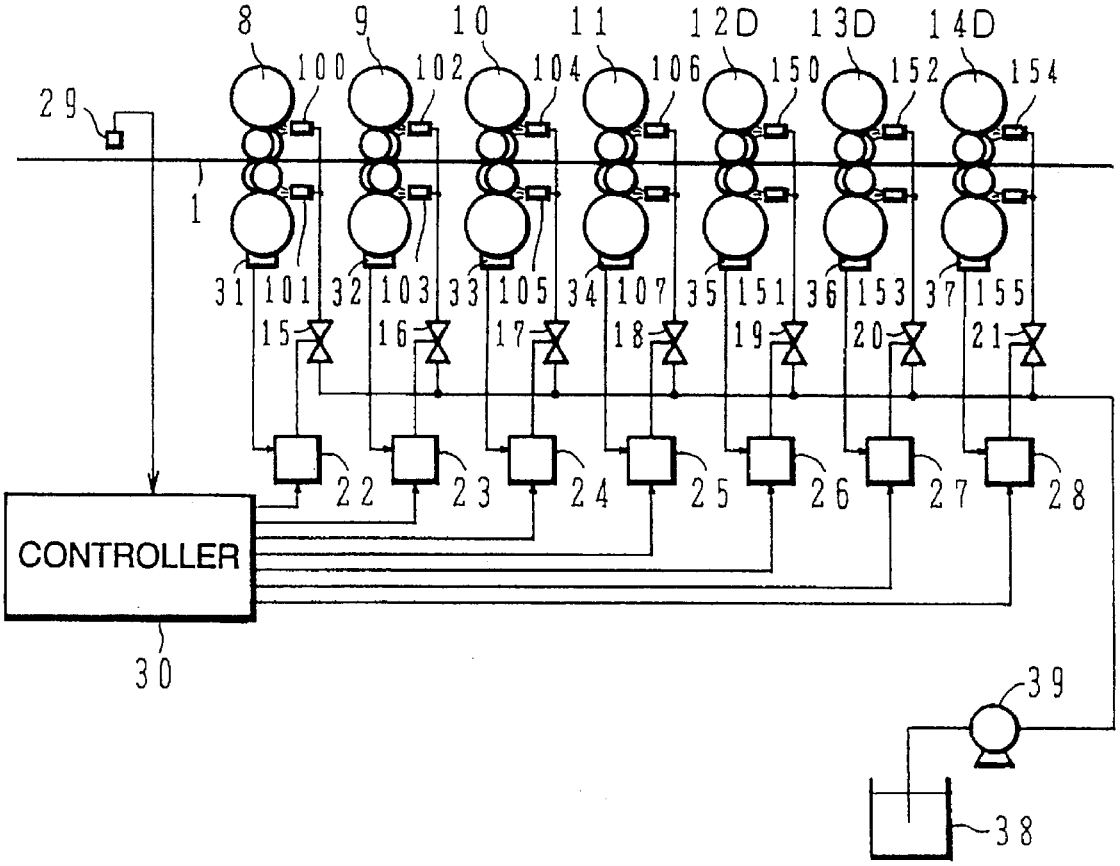
FIG. 23 is a schematic view of a tandem mill system according to still another embodiment of the present invention.

More specifically, in the embodiment shown in FIG. 23, the work roll crossing mills, each being shown in FIG. 2, are arranged as the first type rolling mills 8 to 11 and second type rolling mills 12D to 14D in all the first to seventh stands. The strip 1 is successively rolled by those work roll crossing mills in tandem.

In the work roll crossing mill shown in FIG. 2, as mentioned before, the pair of work rolls 2, 3 are inclined with respect to the pair of back-up rolls 6, 7 supporting the work rolls 2, 3 and simultaneously crossed each other in respective a horizontal planes, thus controlling the transverse thickness distribution of the strip.

Also, in the work roll crossing mill, since thrust forces are produced between the work rolls 2, 3 and the back-up rolls 6, 7, a lubricant is supplied to the roll-to-roll gap for making the coefficient of friction smaller. However, if the coefficient of friction becomes too small, there occurs a slip when the work rolls are going to bite the strip, which leads to an incapability of the rolling. For this reason, the amount of lubricant supplied is preferable to be as small as possible. It is also preferable to stop supply of the lubricant immediately before biting of the strip and start the supply again after the biting.

In this embodiment of FIG. 23, therefore, the first type rolling mills (work roll crossing mills) 8 to 11 and the second type rolling mills (work roll crossing mills) 12D to 14D are associated with a lubricant supply device which comprises valves 15 to 21, nozzles 100 to 107 and 150 to 155, a tank 38 as a supply source of the lubricant, and a pump 39. The valves 15 to 21 of the lubricant supply device are controlled by supply amount adjusters 22 to 28 and a controller 30. A strip sensor 29 is provided in the entrance side of a train of the rolling mills to detect the presence or absence of the strip 1. The presence of the strip is usually detected by using a thermometer. Further, load cells 31 to 37 are provided in the respective stands to detect biting of the strip.

When the strip sensor 29 detects that the strip has entered, a detected signal is taken by the controller 30 from which a supply Stop signal is immediately transmitted to the supply amount adjuster 22 for the first stand. Threading speeds for the respective stands are previously input in the controller 30 which calculates periods of time required for the strip to pass the stand-to-stand distances and successively transmits supply stop signals to the supply amount adjusters for the subsequent stands with lags corresponding to the calculated periods of time. Meanwhile, the supply of the lubricant must be started again immediately after biting of the strip. To this end, the biting is detected by the load cells 31 to 37 provided on the respective stands, whereupon supply start signals are output to the supply amount adjusters 22 to 28. The lubricant is sent from the tank 38 as a supply source by the pump 39. By so controlling the supply of the lubricant, troubles due to excessive thrust forces and slip troubles at the time of biting are eliminated, with the result of improved production efficiency.

Furthermore, rolling schedule is generally determined so that rolling power becomes uniform throughout all the stands. Therefore, rolling load is not always on the same order in all the stands. There is such a tendency that rolling load is large in the upstream stands corresponding to a slow threading speed and, to the contrary, it is small in the downstream stands. Because thrust forces produced in the work roll crossing mill are almost proportional to rolling load, the upstream stands undergo larger thrust forces than the downstream stands and require more frequent replacement of the rolls and bearings, meaning that maintenance time has been wasted. This disadvantage can be eliminated by using, in the upstream stands, a lubricant with a greater capability of reducing the friction force than that of a lubricant used in the downstream stands.

Figure 24:
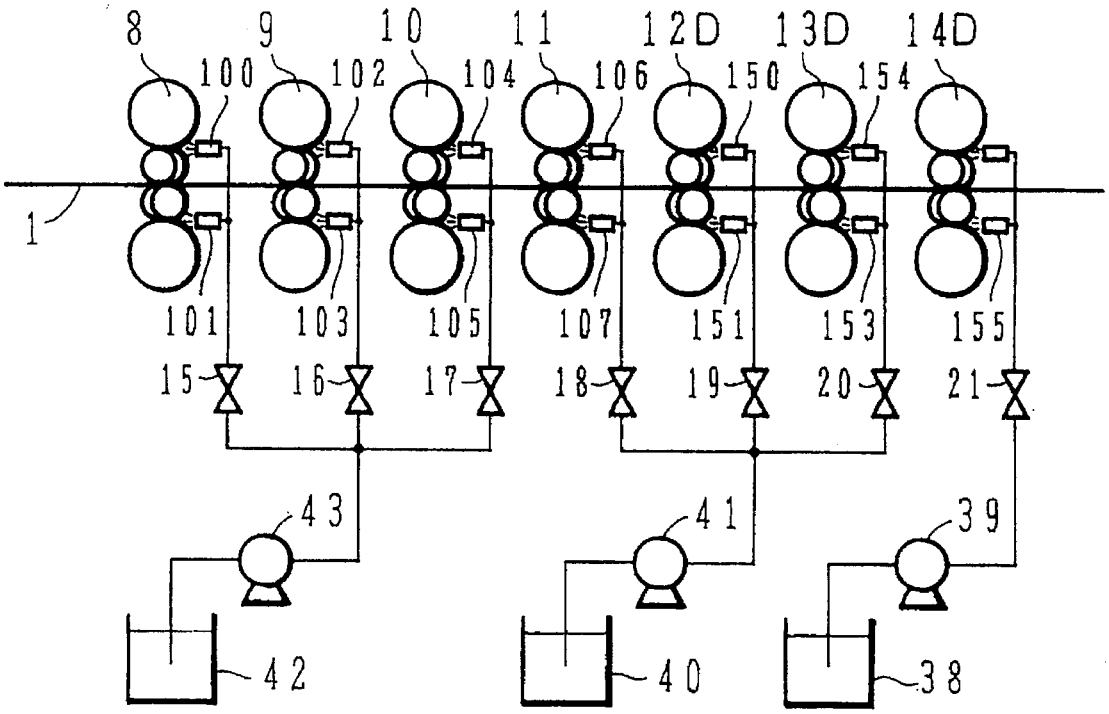
FIG. 24 is a schematic view of a tandem mill system according to still another embodiment of the present invention.

In this embodiment of FIG. 24, therefore, the first type rolling mills (work roll crossing mills) 8 to 11 and the second type rolling mills (work roll crossing mills) 12D to 14D are divided into three groups and, correspondingly to these groups, the lubricant supply device is also divided into three groups. A lubricant with the greatest capability of reducing the friction force or a lubricant with highest density is supplied to the first group of upstream work roll crossing mills 8, 9, 10 from a tank 42 by a pump 43, a different lubricant, i.e., a lubricant with a smaller capability of reducing the friction force or a lubricant with lower density is supplied to the second group of work roll crossing mills 11, 12D, 13D from a tank 40 by a pump 41, and further a lubricant with the smallest capability of reducing the friction force or a lubricant with lowest density is supplied to the third group of work roll crossing mills 14D from the tank 38 by the pump 39. By so supplying three kinds of lubricants, it is possible to make the thrust forces uniform in all the stands, cut down the time wastefully consumed, and hence improve production efficiency. Further, the amount of lubricant used is diminished.

Moreover, in the above embodiments of FIGS. 23 and 24, the same lubricant is supplied to the upper and lower rolls. In many usual cases, however, roll lubricating conditions are different between the upper and lower sides, and roll wears are also different between the upper and lower sides. Generally, since a large amount of cooling water is used in hot rolling, the lubricant is more easily washed away in the lower rolls. Therefore, the coefficient of friction in the lower side is increased and wears of the lower rolls become larger correspondingly.

Figure 25:
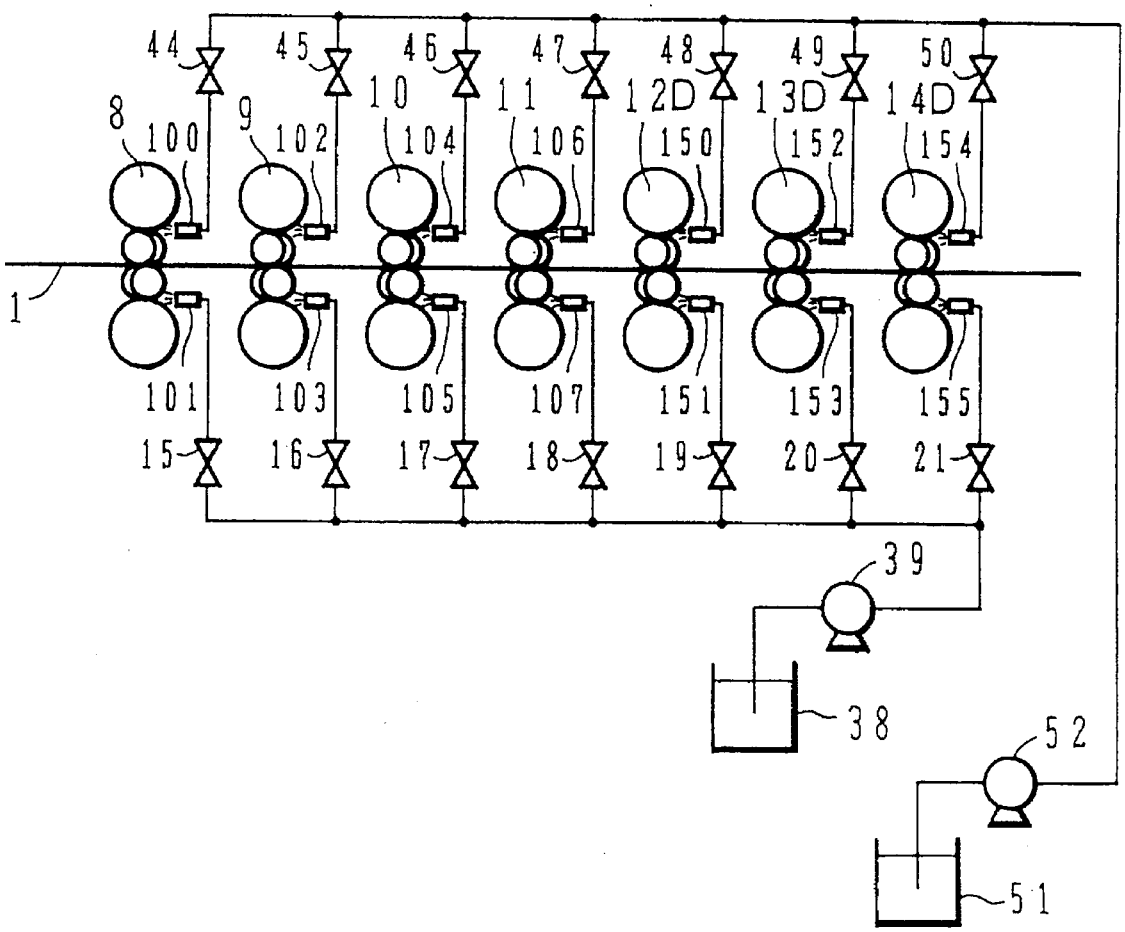
FIG. 25 is a schematic view of a tandem mill system according to still another embodiment of the present invention.

Taking the above into account, in this embodiment of FIG. 25, a lubricant supply system is divided into two lines between the upper rolls and the lower rolls of the rolling mills for supplying lubricants with different densities therethrough. More specifically, valves 44 to 50 and the nozzles 100, 102, 104, 106, 150, 152, 154 are provided as a device for supplying a lubricant to the upper rolls, whereas the valves 15 to 21 and the nozzles 101, 103, 105, 107, 151, 153, 155 are provided as a device for supplying a lubricant to the lower rolls. The lubricant for the upper rolls is supplied to the upper roll system from a tank 51 by a pump 52, and the lubricant with higher density than the lubricant for the upper rolls is supplied to the lower roll system from the tank 38 by the pump 39. By so arranging, it is possible to prevent abnormal wear of the lower rolls, cut down the time wastefully consumed for roll replacement, and hence improve production efficiency.

Figure 20:
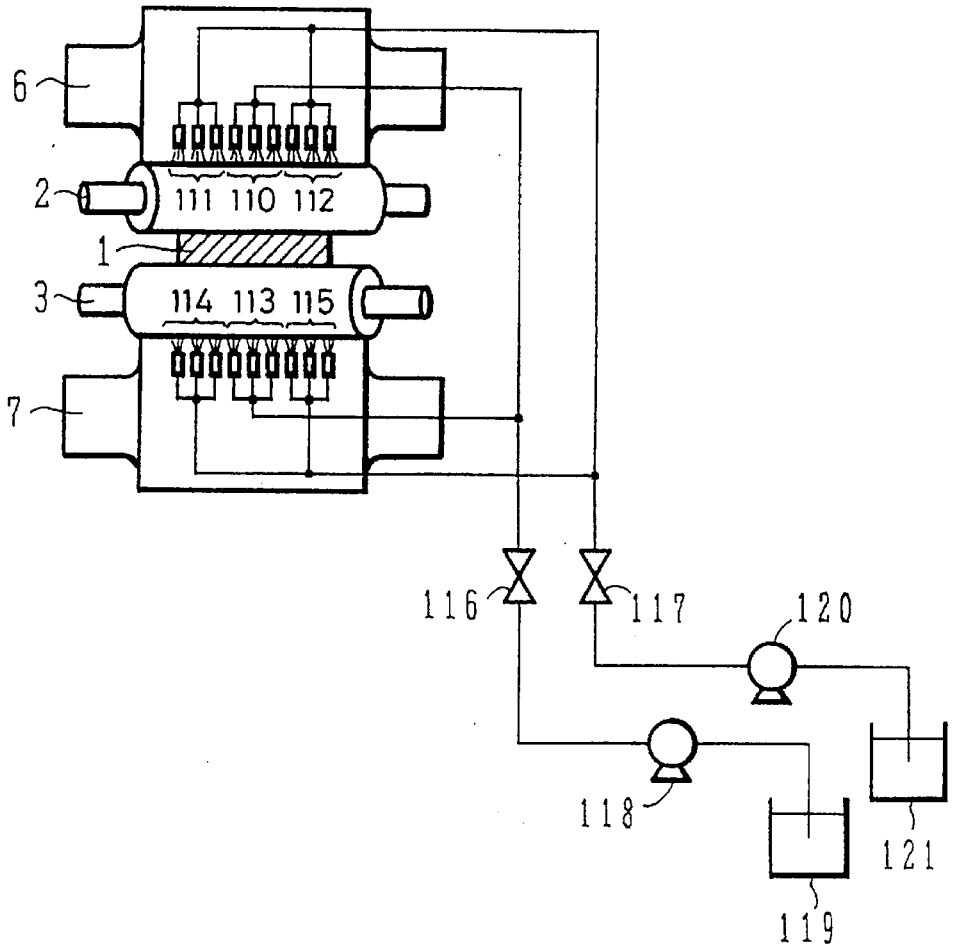
FIG. 20 is a schematic view of a work roll crossing mill according to a ninth embodiment of the present invention.
Figure 21:
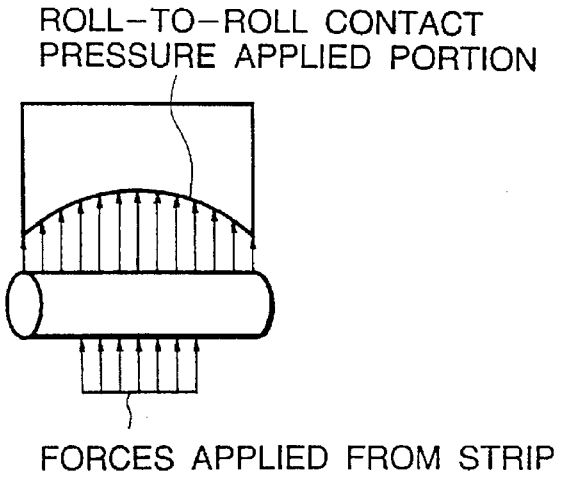
FIG. 21 is a view showing distribution of roll-to-roll friction forces in a rolling mill.

Though not Shown, it is a matter of course that any of the line constructions of the lubricant supply device shown in FIGS. 20 and 22 may be applied to the tandem mill system comprising the work roll crossing mills arranged in all the first to seventh stands.

While several embodiments of the present invention have been described above, the present invention is not limited to the illustrated embodiments and various modifications can be envisaged. For example, the number of stands constituting the tandem mill system is not limited to seven in the embodiments and may be any desired number. Also, the ratio between different types of rolling mills, such as work roll crossing mills and the HC mills, in the tandem mill system can be variously set other than the ratios used in the embodiments.

According to the present invention, as fully described above, since a work roll crossing mill and another type rolling mill having a shape control function of giving an influence upon the transverse thickness distribution pattern of a strip different from that given by the work roll crossing mill are arranged in a combined manner, it is possible to increase a capability of correcting the quarter buckle, manufacture high-quality products, keep the roll surfaces always free from scratches based on a roll grinding effect, and further improve both yield and production efficiency. In hot rolling, since large-diameter work rolls can be used, the work rolls are prevented from being heated up to high temperatures to thereby suppress deterioration of the roll material, and positive biting of thick strips can be ensured.

According to the present invention, it is also possible to stop supply of a lubricant immediately before biting of the strip into the work roll crossing mill and start the supply again after the biting. As a result, slip troubles at the time of biting are eliminated and production efficiency is improved.

Further, according to the present invention, the amount of lubricant used can be reduced while providing required lubrication to the work roll crossing mill.

Additionally, according to the present invention, when thrust forces produced in the work roll crossing mill becomes too large, the coefficient of friction can be lowered so as to prevent a trouble of roll seizure or the like and hence prolong the service life of the rolls.

What is claimed is:

1. A work roll crossing mill comprising a pair of work rolls and a pair of back-up rolls, said pair of work rolls being inclined with respect to said pair of back-up rolls supporting said work rolls and being simultaneously crossed with respect to each other in respective horizontal planes to control transverse thickness distribution of a strip, wherein:

said mill includes thrust force reducing means for reducing thrust forces exerted on said pair of back-up rolls and pair of work rolls due to rotation thereof while the axes of said work rolls are crossed with respect to each other, said thrust force reducing means including plural lines of lubricant supply means for supplying a lubricant between said work rolls and said back-up rolls supporting said work rolls, said plural lines of lubricant supply means having respective lubricant supply sources per line.

2. A tandem mill system in which a plurality of rolling mills are arranged along a rolling line, comprising:

(a) said plurality of rolling mills including a plurality of work roll crossing mills each of which comprises a pair of work rolls and a pair of back-up rolls, said pair of work rolls being inclined with respect to said pair of back-up rolls supporting said work rolls and simultaneously crossed each other in respective horizontal planes to control transverse thickness distribution of a strip; and (b) thrust force reducing means for reducing thrust forces exerted on said pair of back-up rolls and pair of work rolls due to rotation thereof while the axes of said work rolls are crossed with respect to each other, said thrust force reducing means including plural lines of lubricant supply means provided for said plurality of work roll crossing mills for lubricating between said work rolls and said back-up rolls supporting said work rolls, said plural lines of lubricant supply means having respective lubricant supply sources per line.

3. A tandem mill system according to claim 2, wherein said plurality of work roll crossing mills are divided into plural groups in a direction of movement of said strip, and said plural lines of lubricant supply means are divided into plural lines corresponding to the plural groups of said work roll crossing mills.

4. A tandem mill system according to claim 3, wherein out of said plural lines of lubricant supply means, the line corresponding to an upstream group of said work roll crossing mills has said lubricant supply source containing a lubricant with a first density, and the line corresponding to a downstream group of said work roll crossing mills has said lubricant supply source containing a lubricant with a second density lower than the first density.

5. A tandem mill system according to claim 2, wherein said plural lines of lubricant supply means are divided into two lines corresponding to upper rolls and lower rolls of said work roll crossing mills.

6. A tandem mill system according to claim 5, wherein out of said two lines of lubricant supply means, the line corresponding to said upper rolls has said lubricant supply source containing a lubricant with a first density, and the line corresponding to said lower rolls has said lubricant supply source containing a lubricant with a second density lower than the first density.

7. A tandem mill system according to claim 2, wherein said plural lines of lubricant supply means have a number of nozzles arranged along a roll axial direction in each of said work roll crossing mills, said number of nozzles are divided into plural groups in the roll axial direction, and said plural lines of lubricant supply means are divided into plural lines corresponding to the plural groups of said nozzles.

8. A tandem mill system according to claim 7, wherein out of said plural lines of lubricant supply means, the line corresponding to the nozzle group in a roll central portion has said lubricant supply source containing a lubricant with a first density, and the line corresponding to the nozzle group in a roll end portion has said lubricant supply source containing a lubricant with a second density which is lower than the first density.

9. A tandem mill system according to claim 2, wherein said plural lines of lubricant supply means each have a number of nozzles arranged along a roll axial direction in each of said work roll crossing mills, and said lubricant supply sources for said plural lines of lubricant supply means contain lubricants with different densities.

10. A tandem mill system in which a plurality of rolling mills are arranged along a rolling line, said plurality of rolling mills including:

(a) at least one first type rolling mill comprising a pair of work rolls and a pair of back-up rolls, said pair of work rolls being inclined with respect to said pair of back-up rolls supporting said work rolls and the back-up rolls being fixed in position in respective horizontal planes while the work rolls are changed in a cross angle formed therebetween in a horizontal plane thereby to control transverse thickness distribution of a strip; and (b) at least one second type rolling mill having a shape control function of providing an influence upon a pattern of the transverse thickness distribution of said strip different from an influence provided by said first type rolling mill, wherein said first type rolling mill includes thrust force reducing means for reducing thrust forces exerted on said pair of back-up rolls and pair of work rolls due to rotation thereof while the axes of said work rolls are crossed with respect to each other, said thrust force reducing means including lubricant supply units arranged to respectively face said pair of back-up rolls for spraying a lubricant onto surfaces of said back-up rolls at locations spaced from contact positions between said pair of work rolls and said pair of back-up rolls, thereby lubricating between said work rolls and said back-up rolls supporting said work rolls.

11. A tandem mill system according to claim 10, wherein said first type rolling mill is arranged in at least a head stand of said plurality of rolling mills.

12. A tandem mill system according to claim 10, wherein said second type rolling mill is arranged in at least a tail stand of said plurality of rolling mills.

13. A tandem mill system according to claim 10, wherein said first type rolling mill is arranged in a stand upstream of said second type rolling mill.

14. A tandem mill system according to claim 10, wherein said first type rolling mill includes means for controlling a cross angle of said pair of work rolls during the rolling in which said strip is passing said first type rolling mill.

15. A tandem mill system according claim 10, further including:

(c) first detection means provided upstream of said first type rolling mill for detecting the presence or absence of said strip;

(d) second detection means provided for said first type rolling mill for detecting biting of said strip; and (e) control means for controlling said lubricant supply means in response to signals from said first and second detection means to stop supply of the lubricant immediately before biting of the strip into the first type rolling mill and start the supply again after the biting.

16. A tandem mill system according to claim 10, wherein:

said lubricant supply means includes plural lines of lubricant supply means, said plural lines of lubricant supply means having respective separate lubricant supply sources per line.

17. A tandem mill system according to claim 16, wherein said first type rolling mill is provided plural in number, said plural first type rolling mills are divided into plural groups in a direction of movement of said strip, and said plural lines of lubricant supply means are divided into plural lines corresponding to the plural groups of said first type rolling mills.

18. A tandem mill system according to claim 17, wherein out of said plural lines of lubricant supply means, the line corresponding to an upstream group of said first type rolling mills has said lubricant supply source containing a lubricant with a first density, and the line corresponding to a downstream group of said first type rolling mills has said lubricant supply source containing a lubricant with a second density lower than the first density.

19. A tandem mill system according to claim 16, wherein said plural lines of lubricant supply means are divided into two lines corresponding to the upper rolls and the lower rolls of said first type rolling mill.

20. A tandem mill system according to claim 19, wherein out of said two lines of lubricant supply means, the line corresponding to said upper rolls has said lubricant supply source containing a lubricant with a first density, and the line corresponding to said lower rolls has said lubricant supply source containing a lubricant with a second density lower than the first density.

21. A tandem mill system according to claim 16, wherein said plural lines of lubricant supply means have a number of nozzles arranged along a roll axial direction in said first type rolling mill, said number of nozzles are divided into plural groups in the roll axial direction, and said plural lines of lubricant supply means are divided into plural lines corresponding to the plural groups of said nozzles.

22. A tandem mill system according to claim 21, wherein out of said plural lines of lubricant supply means, the line corresponding to the nozzle group in a roll central portion has said lubricant supply source containing a lubricant with a first density, and the line corresponding to the nozzle group in a roll end portion has said lubricant supply source containing a lubricant with a second density lower than the first density.

23. A tandem mill system according to claim 16, wherein said plural lines of lubricant supply means each have a number of nozzles arranged along a roll axial direction in said first type rolling mill, and said lubricant supply sources for said plural lines of lubricant supply means contain lubricants with different densities.

24. A method of operating a tandem mill system of the type in which a plurality of rolling mills are arranged along a rolling line, said plurality of rolling mills including:

(a) at least one first type rolling mill comprising a pair of work rolls and a pair of back-up rolls, said pair of work rolls being inclined with respect to said pair of back-up rolls supporting said work rolls and the back-up rolls being fixed in position in respective horizontal planes while the work rolls are changed in a cross angle formed therebetween in a horizontal plane thereby to control transverse thickness distribution of a strip; and (b) at least one second type rolling mill having a shape control function of providing an influence upon a pattern of the transverse thickness distribution of said strip different from an influence provided by said first type rolling mill, said method comprising:

reducing thrust forces exerted on said pair of back-up rolls and said pair of work rolls of said first type rolling mill due to rotation of said rolls while the axes of said work rolls are crossed with respect to each other, said reducing thrust forces including supplying a lubricant to said first type rolling mill during rolling operations to a location between said work rolls and said back-up rolls supporting said work rolls.

25. A method according to claim 24, wherein said first type rolling mill is provided plural in number, said plural first type rolling mills are divided into plural groups in a direction of movement of said strip, and said plural lines of lubricant supply means are divided into plural lines corresponding to the plural groups of said first type rolling mills, wherein said supplying of lubricant includes supplying a lubricant with a first density to an upstream group of said first type rolling mills and supplying a lubricant of a second density lower than the first density to a line corresponding to a downstream group of said first type rolling mills.

26. A method according to claim 24, comprising detecting the presence or absence of a strip upstream of said first type rolling mill, detecting biting of said strip in said first type rolling mill, and controlling the supply of lubricant in response to detection of the presence or absence of said strip and the biting of such strip so as to stop supply of the lubricant immediately before biting of the strip into the first type rolling mill and to start supply of the lubricant again after the biting.

* * * * *